US006644183B2

(12) United States Patent
Takasawa et al.

(10) Patent No.: US 6,644,183 B2
(45) Date of Patent: Nov. 11, 2003

(54) MULTI-COLOR PRINTING METHOD AND SYSTEM INCLUDING A PLURALITY OF REMOVABLE INK DRUMS

(75) Inventors: Hironobu Takasawa, Watari-gun (JP); Manabu Wakamatsu, Watari-cho (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 10/119,947

(22) Filed: Apr. 11, 2002

(65) Prior Publication Data

US 2002/0108514 A1 Aug. 15, 2002

Related U.S. Application Data

(62) Division of application No. 09/164,372, filed on Oct. 1, 1998, now Pat. No. 6,371,016.

(30) Foreign Application Priority Data

Nov. 21, 1997 (JP) ..... 9-321702
Jun. 15, 1998 (JP) ..... 10-167322

(51) Int. Cl.[7] ..... B41F 15/04

(52) U.S. Cl. ..... 101/115; 101/127.1; 101/211; 101/409

(58) Field of Search ..... 101/118–119, 128.4, 101/129, 126, 127, 127.1, 211, 409; 427/282

(56) References Cited

U.S. PATENT DOCUMENTS 3,915,087 A * 10/1975 Tiemann ..... 101/115
3,941,054 A * 3/1976 Springer ..... 101/409
4,366,542 A * 12/1982 Anselrode ..... 101/116
4,628,813 A * 12/1986 Hasegawa et al. ..... 101/116
4,718,340 A * 1/1988 Love, III ..... 101/116
4,887,168 A * 12/1989 Endo et al. ..... 101/128.4
4,905,595 A * 3/1990 Jeschke ..... 101/211
4,967,287 A * 10/1990 Nakatani ..... 101/114
5,048,416 A * 9/1991 Iijima ..... 101/115
5,165,338 A * 11/1992 Okazaki et al. ..... 101/118
5,207,157 A * 5/1993 Okazaki et al. ..... 101/116
5,224,419 A * 7/1993 Fukai ..... 101/128.4
5,404,805 A * 4/1995 Fujimoto et al. ..... 101/118
5,558,019 A * 9/1996 Kawai et al. ..... 101/116
5,632,200 A * 5/1997 Fukai ..... 101/116
5,640,904 A * 6/1997 Sato et al. ..... 101/128.4
5,671,670 A * 9/1997 Takahashi et al. ..... 101/116
5,673,619 A * 10/1997 Ohinata et al. ..... 101/116
5,786,029 A * 7/1998 Watanabe ..... 427/282
5,799,577 A * 9/1998 Takahashi ..... 101/127
5,809,879 A * 9/1998 Yokoyama et al. ..... 101/128.4
5,813,329 A * 9/1998 Tateishi et al. ..... 101/116
5,816,149 A * 10/1998 Kagawa et al. ..... 101/128.4
5,857,410 A * 1/1999 Watanabe et al. ..... 101/116
5,893,323 A * 4/1999 Ishii et al. ..... 101/116
5,924,360 A * 7/1999 Adachi et al. ..... 101/116
5,970,866 A * 10/1999 Okawa ..... 101/118
5,988,061 A * 11/1999 Kagawa ..... 101/128.4
6,371,016 B2 4/2002 Takasawa et al. ..... 101/129

FOREIGN PATENT DOCUMENTS

JP 3-55276 * 3/1991
JP 6-32038 * 2/1994
JP 7-17121 * 1/1995
JP 8-216381 * 8/1996
JP 9-104158 * 4/1997

* cited by examiner

*Primary Examiner*—Eugene H. Eickholt
(74) *Attorney, Agent, or Firm*—Oblon, Spivak, McClelland, Maier & Neustadt, P.C.

(57) ABSTRACT

A multicolor printing method and system including a master making device having plurality of removable ink drums replaceable with each other and a printing device. The plurality of removable ink drums are fed with respective masters to be used for printing, by fixed master feeding devices smaller in number than the removable ink drums. The removable ink drums fed with respective masters are then used by the printing device for printing onto paper. The method and system provides multicolor printing with lower cost, reduced size and accurate registration between the respective masters, as compared to conventional methods and systems.

18 Claims, 16 Drawing Sheets

MULTI-COLOR PRINTING METHOD AND SYSTEM INCLUDING A PLURALITY OF REMOVABLE INK DRUMS

CROSS-REFERENCE TO RELATED APPLICATIONS

This application is a divisional application of, and claims priority to, Ser. No. 09/164,372, filed on Oct. 1, 1998 now U.S. Pat. No. 6,371,016 and claims priority to Japanese Application No. JP 9-321702, filed on Nov. 21, 1997 and Japanese Application No. JP 10-167322, filed on Jun. 15, 1998. The entire contents of the parent application and the Japanese applications are incorporated herein by reference.

BACKGROUND OF THE INVENTION

1. Field of the Invention

The present invention relates to a printing method using an ink drum around which a master is wrapped and a system therefor and, more particularly, to a printing method using a plurality of ink drums each being loaded with a respective master for effecting multicolor printing and a system therefor.

2. Discussion of Background

To produce a color printing or similar multicolor or printing with the above digital stencil printer, it is necessary for the operator to replace the ink drum color by color. For example, to produce a bicolor printing, the operator must accurately position a stack of papers carrying images of first color produced with an ink drum of a first color, again stack them on a paper feed section, replace the ink drum with an ink drum of a second color, and repeat printing. While images of the second color must be brought into register with the images of the first color, it is difficult to accurately position the papers fed at the second time, often resulting in misregister. Further, when the images are not fully dry, it is likely that the papers jam a transport path due to the viscosity of ink or that ink deposits on, e.g., rollers arranged on the transport path and smear images printed on the following papers. Moreover, to produce an image in two or more colors, the above procedure must be repeated, consuming a prohibitive period of time and multiplying the above problems.

To solve the problems particular to the single drum type stencil printer, Japanese Patent Laid-Open Publication Nos. 3-55276 and 6-32038, for example, each proposes a plural drum type stencil printer including a plurality of ink drums each being assigned to a particular color. With the plurality of ink drums, the stencil printer continuously prints images of different colors on a single paper one above the other while automatically conveying the paper.

The plural drum type stencil printer allocates exclusive master discharging means, master making means, master feeding means and so forth to each ink drum, as shown and described in the above Laid-Open Publication No. 6-32038. This type of printer is, however, greater in size than the single drum type printer because it needs a plurality of ink drums, e.g., three or four drums in the case of color printing. Moreover, the master discharging device, master making device, master feeding device and so forth allocated to each of the ink drums further increase the size and cost of the printer. This is contradictory to the increasing demand for, e.g., downsizing required of office automation equipment.

In the stencil printer taught in Laid-Open Publication No. 3-55276 mentioned earlier, master discharging means, master making means, master feeding means and so forth are constructed into an integral unit movable to cope with a plurality of ink drums. That is, the single movable unit is shared by a plurality of ink drums. However, to move such a unit, the construction and control of the printer is sophisticated. In addition, although the above means are shared by the ink drums, a space for allowing the unit to move must be provided around each of the ink drums and obstructs downsizing.

Another problem with the printer of Laid-Open Publication No. 6-32038 is that registration errors between masters are not avoidable due to the independent means. For example, even when a document is sized 200 mm, a master of first color and a master of second color may be sized, e.g., 200.3 mm and 199.8 mm by way of example. It is therefore necessary to control the dimensions of the masters to be fed to the respective drums to 200 mm. Moreover, the master of first color and the master of second color may be respectively +0.3 mm and −0.1 mm as to the top-and-bottom registration. This must be adjusted also.

Even the printer taught in Laid-Open Publication No. 3-55276 cannot avoid errors relating to the movement of the single unit, also resulting in errors in registration.

Technologies relating to the present invention are also disclosed in, e.g., Japanese Patent Laid-Open Publication Nos. 7-17121, 8-216381 and 9-104158, and U.S. patent application Ser. No. 09/079,287 now U.S. Pat. No. 6,067.902 (corresponding to Japanese Patent Application No. 9-131428).

SUMMARY OF THE INVENTION

It is therefore an object of the present invention to provide a printing system enhancing a low cost, downsizing feature and insuring highly accurate registration at the time of master feed, and a system therefor.

In accordance with the present invention, in a multicolor printing method, a plurality of removable ink drums replaceable with each other are fed with respective masters by fixed master feeding devices smaller in number than the ink drums via the replacement of the ink drums and are used for printing.

Also in accordance with the present invention, in a multicolor printing method, after a master has been wrapped around an ink drum by a master making device including a master feeding function and a master discharging function, the ink drum is mounted to a multicolor printing device capable of accommodating a plurality of removable ink drums, but void of a master making arrangement including a master feeding function and a master discharging function, and used for printing.

Further in accordance with the present invention, a multicolor printing system includes a master making device capable of feeding a new master and discharging a used master and allowing an ink drum to be removably mounted thereto, a multicolor printer loaded with a plurality of removable ink drums, but void of a master making arrangement including a master feeding function and a master discharging function, and a plurality of ink drums shared b y the master making device and multicolor printer.

Moreover, in accordance with the present invention, a multicolor printing system includes a plurality of removable ink drums replaceable with each other and capable of implementing simultaneous multicolor printing, a fixed master feeding device shared by the plurality of ink drums, and at least one master discharging device.

BRIEF DESCRIPTION OF THE DRAWINGS

The above and other objects, features and advantages of the present invention will become more apparent from the following detailed description taken with the accompanying drawings in which.

Figure 1:
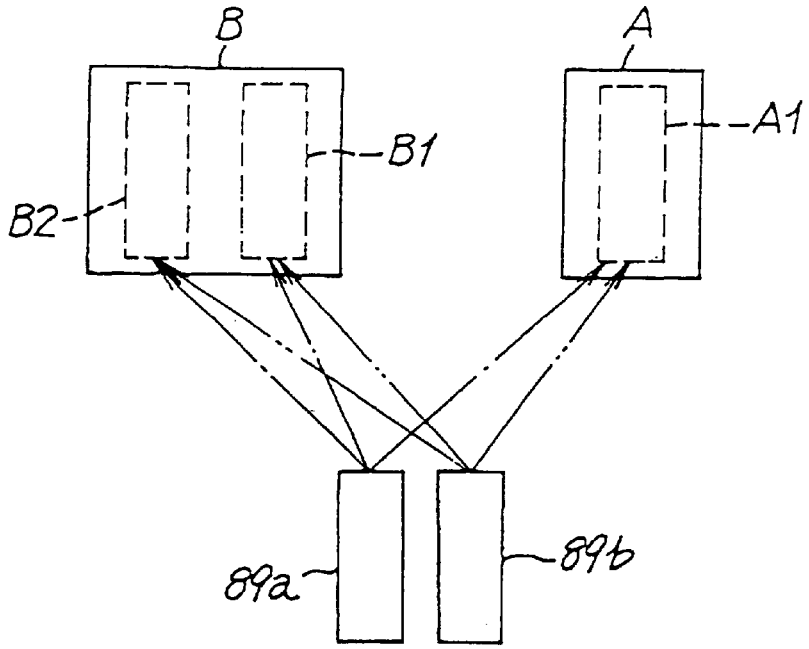
FIG. 1 is a plan view showing a multicolor printing system embodying the present invention.

In the drawings, identical references denote identical structural elements.

DESCRIPTION OF THE PREFERRED EMBODIMENTS

To solve the problems of the conventional technologies ascribable to the full automatic construction, the present invention allows master feeding means to be fixedly shared by a plurality of ink drums, taking account of the merits of partial manual operation. Specifically, a plurality of removable ink drums replaceable with each other are fed with respective masters by fixed master feeding devices smaller in number than the ink drums via the replacement of the drums and are used for printing. It is to be noted that the word "fixed" means that the master feeding device or devices are positionally fixed in relation to the ink drums and in the procedure for feeding masters to the drums.

Referring to FIG. 1 of the drawings, a multicolor printing system embodying the present invention is shown. As shown, the system is generally made up of two stencil printers A and B and two ink drums 89*a* and 89*b* shared by the stencil printers A and B. The stencil printer A is a single drum type printer and plays the role of a master making device while the stencil printer B is a plural drum type printer.

The printer A is capable of wrapping a master around either one of the ink drums 89*a* and 89*b*. The printer B is a multicolor printer which can be loaded with both of the drums 89*a* and 89*b* for printing an image in, e.g., black and red at a time. The printer A includes a drum mounting section A1, as indicated by a dashed line in FIG. 1. The printer B includes two drum mounting sections B1 and B2, as indicated by dashed lines in FIG. 1. The printer A has paper feeding means, paper discharging means, and master making means. By contrast, the printer B has only paper feeding means and paper discharging means, i.e., lacks master making means and is therefore compact in configuration.

The printer A is a conventional printer operable with a single replaceable ink drum. The printer B is added to the printer A to constitute the system. The printer A wraps a particular master around each of the ink drums 89*a* and 89*b*. The ink drums 89*a* and 89*b* with the masters are mounted to the printer B for effecting only printing.

Figure 2A:
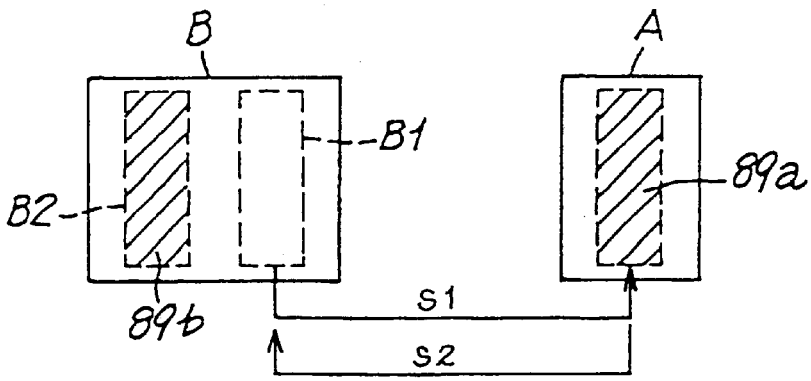
FIG. 2A shows how a used master is removed from a right ink drum included in a stencil printer or multicolor printer, and a new master is fed to the same ink drum.

The above multicolor printing system is used as follows. First, as shown in FIG. 2A, the ink drum 89*a* storing black ink is removed from the drum mounting section B1 of the printer B and then mounted to the printer A (S1). Then, the printer A peels off a used master from the ink drum 89*a* (master discharging), perforates a stencil in accordance with image data representative of a black image (master making), and wraps the resulting new master around the ink drum 89*a* (master feeding). In this condition, the printer A is operated to output several printings (trial printing). Specifically, just after a new master has been wrapped around an ink drum, ink cannot sufficiently spread over the master. In light of this, during the trial printing, a pressing member presses the outer periphery of the ink drum so as to spread the ink over the entire master. The ink drum 89*a* with the new master is removed from the printer A and again mounted to the drum mounting section B1 of the printer B (S2).

Figure 2B:
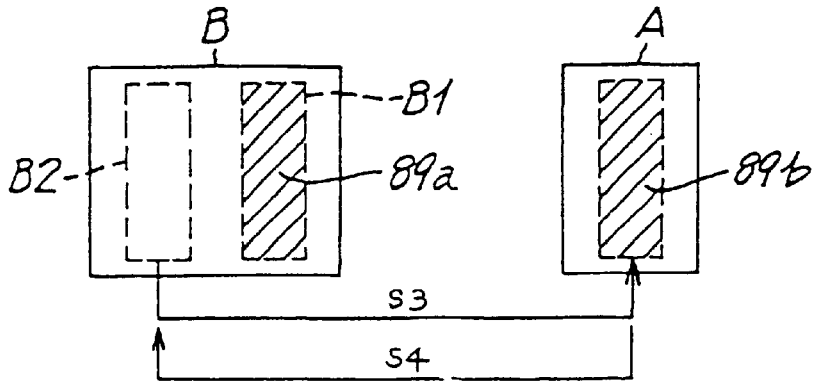
FIG. 2B shows how a used master is removed from a left ink drum included in the stencil printer, and a new master is fed to the same ink drum.

Subsequently, as shown in FIG. 2B, the ink drum 89*b* storing red ink is removed from the drum mounting section B2 of the printer B and then mounted to the printer A (S3). The printer A peels off a used master from the ink drum 89*b*, perforates a stencil in accordance with image data representative of a red image, and wraps the resulting new master around the ink drum 89*b*. After trial printing executed with this new master, the ink drum 89*b* is removed from the printer A and again mounted to the drum mounting section B2 of the printer B (S4). Then, the operator inputs a desired number of printings on the printer B and presses a print start key, not shown, provided on the printer B. As a result, a black image and a red image are printed on papers one above the other. The papers with such images, i.e., printings are sequentially driven out of the printer B and stacked.

A specific configuration of the printer A will be described with reference to FIG. 3. As shown, the ink drum 89*a* is located at substantially the center of the printer A. A master making device 300 is arranged above and at the right-hand side of the ink drum 89*a*. A paper feeding device 500 is positioned below and at the right-hand side of the ink drum 89*a*. A master discharging device 400 is located above and at the left-hand side of the ink drum 89*a*. A press roller 34 is positioned beneath the ink drum 89*a*. A paper conveyor 600 for discharging a paper or printing is located below and at the left-hand side of the ink drum 89*a*. A document reading section 200 is arranged above the ink drum 89*a*. An ADF (Auto Document Feeder) 2 is disposed above the document reading section 200. The reference numerals 87 and 82 designate a peeler and a tray for stacking printings, respectively.

The ADF 2 conveys a plurality of documents from their stacking position to a reading position on tray 9 one by one. When the ADF 2 is not used, it is raised away from the document reading section 200 so as to allow a document 1 to be laid on a glass platen 3. The document reading section 200 includes a scanning mirror 5 for steering imagewise reflection from the document 1, a pair of mirrors 6 movable at a speed one half of the speed of the mirror 5, a lens 7, a CCD (Charge Coupled Device) image sensor 8 for converting the imagewise reflection incident thereto to a corresponding image signal, and a fluorescent lamp 4 for illuminating the document 1.

The ink drum 89*a* includes of a hollow cylindrical thin plate formed of a porous material and forming the inner periphery of the drum 89*a*, although not shown specifically. A porous elastic layer (mesh screen) covers the outer periphery of the ink drum 89*a* for holding and spreading ink and releasing the ink when pressed. The ink drum 89*a* is rotatably supported by an ink feed shaft 93 and caused to rotate by a motor not shown. Clamping means for clamping a master 94 is mounted on the outer periphery of the ink drum 89*a* and includes a damper 90 and a damper shaft. In FIG. 3, the porous thin plate and porous elastic layer of the ink drum 89*a* are indicated by a single solid line.

The master making device 300 includes a shaft supporting a stencil roll 61 such that a stencil can be paid out from the roll 61, as needed. Master making means mainly consists of a thermal head 63 and a platen roller 71 and selectively perforates the stencil in accordance with image data with heat while pulling it out of the roll 61. A cutter is positioned downstream of the platen roller 71 in the direction of stencil feed and has a rotary movable edge 64 and a stationary edge 65 for cutting the stencil at a preselected length. Because the stencil turns out the master 94 when cut off, it will also be labeled 94 hereinafter.

The platen roller 71 is journalled to opposite side walls included in the printer A and driven by a stepping motor, not shown, mounted on either one of the side walls. The thermal head 63 extends in parallel to the axis of the platen roller 71 and is selectively moved into or out of contact with the platen roller 71 via the stencil 94 by a mechanism not shown. The thermal head 63 selectively perforates, or cuts, the stencil 94 in accordance with digital image signal output from the CCD image sensor 8 and processed by an image processing circuit not shown, as conventional. The rotary edge 64 cuts the stencil 94 by being moved by a motor, not shown, in the direction perpendicular to the sheet surface of FIG. 3, while contacting the stationary edge 65.

Tension rollers 66 and 67 are positioned downstream of the cutter in the direction of stencil feed and conveys the perforated part of the stencil 94 toward the clamping means of the ink drum 89*a*.

The stencil 94 is made up of a porous support and a master film adhered to the porous support. The porous support is implemented by a porous thin sheet of kozo, mitsumata, Manila hemp, flax or similar natural fibers, or unwoven cloth of rayon, vinylon, polyester or similar chemical fibers, or unwoven cloth of natural fibers and chemical fibers. The master film is formed of polyester resin or similar thermoplastic resin. Alternatively, use may be made of a stencil lacking the porous support, i.e., consisting substantially only of a thin elongate polyester film or similar thermoplastic resin film formed with, if necessary, an antistatic agent layer and/or an antistick layer for preventing the stencil from sticking to the heating elements of the thermal head 63.

The clamping means includes a stage mounted on the outer periphery of the ink drum 89*a* and extending in the axial direction of the drum 89*a*, and the previously mentioned damper 90 rotatable about the damper shaft toward and away from the stage.

An ink roller 92 is disposed in the ink drum 89*a* for feeding ink to the inner periphery of the ink drum 89*a*. A doctor roller 91 is positioned in parallel to and slightly spaced from the ink roller 92, forming an ink well 95 between the rollers 91 and 92. The ink feed shaft 93 feeds ink to the ink well 95. Specifically, ink is fed under pressure from an ink pack, not shown, located outside of the ink drum 89*a* to the ink feed shaft 93 by an ink pump not shown. Then, the ink is fed from the ink feed shaft 93 to the ink well 95 while having its amount measured by measuring means not shown. The delivery of the ink from the ink pump is controlled on the basis of the output of the measuring means.

Figure 3:
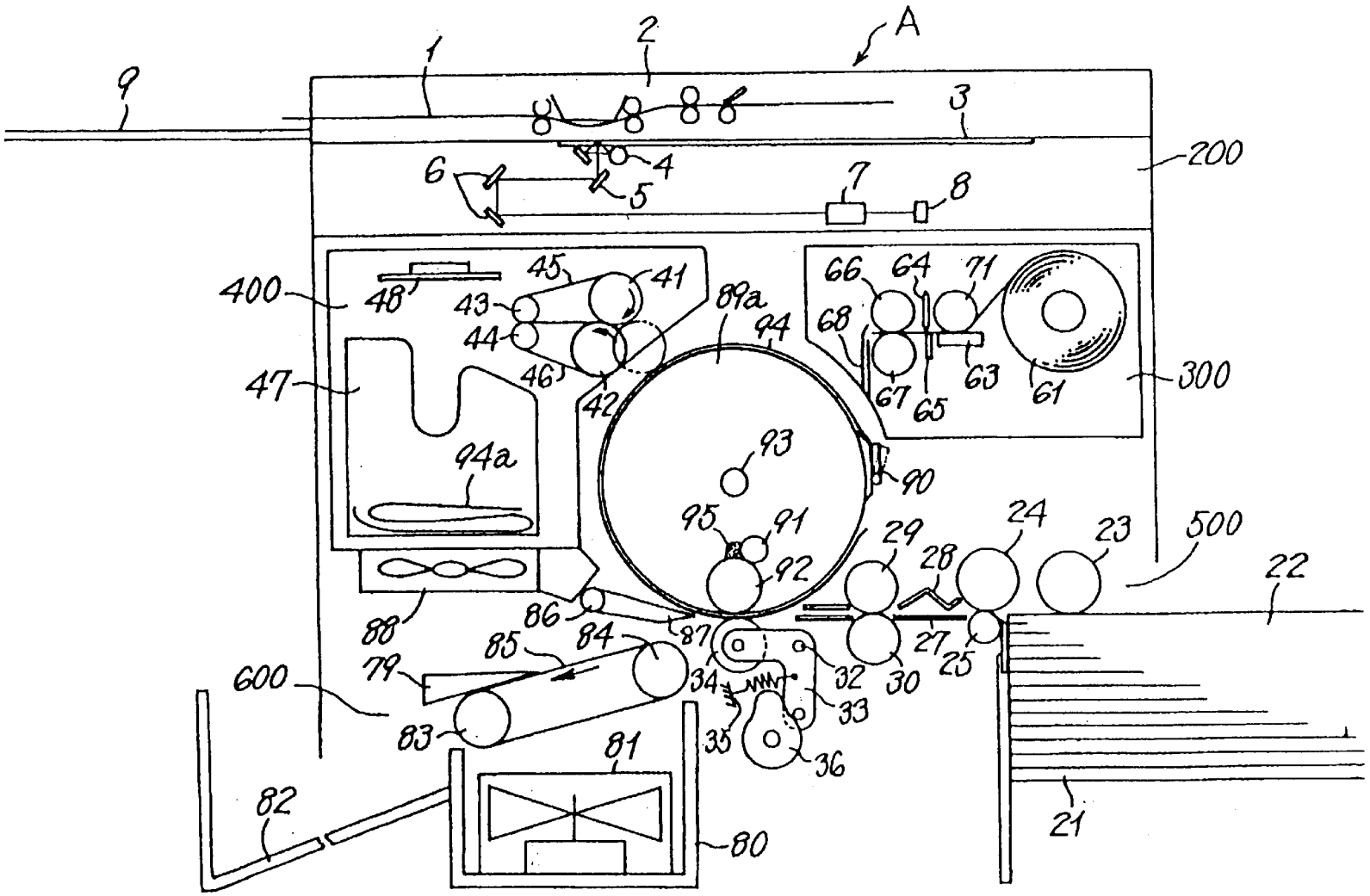
FIG. 3 is a front view showing a stencil printer or master making device also included in the system of FIG. 1.

The ink roller 92 is formed of aluminum, stainless steel or similar metal or rubber and rotated clockwise, as viewed in FIG. 3, together with the ink drum 89*a* via a gear train not shown. The ink roller 92 and ink drum 89*a* are rotated at a preselected speed ratio. The doctor roller 91 is formed of iron, stainless steel or similar metal and rotated counterclockwise, as viewed in FIG. 3, via a gear train not shown. The doctor roller 91 and ink drum 89*a* are also rotated at a preselected speed ratio.

The paper feeding device 500 includes a paper tray 21, a pick-up roller 23, an upper separator roller 24, a lower separator roller 25, and a pair of registration rollers 29 and 30. The paper tray 21 is loaded with a stack of papers 22 and movable up and down relative to the body of the device 500. Specifically, the tray 21 is moved up and down by a motor, not shown, in accordance with an increase or a decrease in the number of papers 22 existing on the tray 21. The pick-up roller 23 and separator rollers 24 and 25 are so positioned at to contact the top paper 22 on the tray 21 and driven by drive means not shown. The registration rollers 29 and 30 are positioned downstream of the separator rollers 24 and 25 in the direction of paper feed. The registration rollers 29 and 30 nip the leading edge of the paper 22 fed thereto from the tray 21 and then conveys it toward a nip between the ink drum 89*a* and the press roller 34 at a preselected timing.

The press roller 34 adjoining the ink drum 89*a* presses the paper 22 fed from the paper feeding device 500 against the ink drum 89*a*. The peeler 87 also adjoining the ink drum 89*a* peels off the paper or printing 22 from the ink drum 89*a*. Specifically, a single peeler 87 is positioned at substantially the center in the direction perpendicular to the sheet surface of FIG. 3. The press roller 34 has an outer periphery implemented by, e.g., rubber and rotatably supported by one end of a press roller arm 33. A tension spring 35 constantly biases the press roller arm 33 such that the press roller 34 tends to approach the ink drum 89*a*. A cam follower is mounted on the other end of the press roller arm 33 and held in contact with a rotatable cam 36. When the cam 36 is rotated in synchronism with the rotation of the ink drum 89*a*, it causes the press roller 34 to move into or out of contact with the ink drum 89*a*. When the press roller 34 is brought into contact with the ink drum 89*a*, it is rotated by the drum 89*a* at the same peripheral speed as the drum 89*a*.

To prevent the paper 22 from adhering to the outer periphery of the ink drum 89*a* and rolling up, the edge of the peeler 87 facing the drum 89*a* is implemented as a nozzle. Air under pressure is sent by a pump, not shown, via the nozzle at a high speed in synchronism with the leading edge of the paper 22, i.e., against the leading edge of the paper 22. The peeler 87 is rotatable about a shaft 86 between a position where it contacts the ink drum 89*a* and a position where the former is spaced from the latter. That is, the peeler 87 is rotated in synchronism with the rotation of the ink drum 89*a* such that its edge does not interfere with the damper 90.

A fan 88 for sending air is positioned at the left-hand side of the peeler 87 in order to help the peeler 87 peel off the paper 22. The paper conveyor 600 is positioned below the peeler 87 for conveying the paper or printing 22. The paper conveyor 600 includes a drive roller 83, a driven roller 84, a belt 85 passed over the drive roller 83 and driven roller 84, a suction fan 81, a jump platform 79, and a casing 80. The drive roller 83 is driven by a drive mechanism, not shown, to cause the belt 85 to rotate at a peripheral speed equal to or slightly higher than the peripheral speed of the ink drum 89*a*.

The peripheral speed of the ink drum 89*a* is equal to a linear velocity at which the paper 22 is conveyed when the press roller 34 is pressed against the drum 89*a*. It is to be noted that the peripheral speed of the belt 85 refers to the linear velocity of the outer periphery of the belt 85 conveying the paper 22. This is also true in the following description.

The belt 85 is formed with a number of apertures. The suction fan 81 sucks the paper 22 separated from the ink drum 89*a* through the apertures of the belt 85. As a result, the paper 22 is held in close contact with the outer surface of the belt 85 and conveyed to the tray 82 thereby.

The fan 88 prevents the paper 22 from rolling up onto the ink drum 89*a* and, for this purpose, sends air under pressure against the surface of the paper 22 from a position above and at the left-hand side of the peeler 87. Also, this air serves to prevent the paper 22 from rising above the belt 85 and to promote the drying of ink transferred to the paper 22.

The master discharging device 400 includes an upper roller 41, a lower roller 42, an upper belt 45, a lower belt 46, an upper roller 43, a lower roller 44, a waste master box 47, and a compression plate 48. The upper roller 41 is journalled to the side walls of the device 400 and caused to rotate clockwise, as viewed in FIG. 3, by a drive mechanism not shown. When the upper roller 41 is rotated, it causes the other upper roller 43 to rotate in the same direction via the upper belt 45. The lower roller 42 is rotated by the upper roller 41 via a gear train mounted on the end of the shaft of the roller 41. Specifically, the upper roller 42 rotates counterclockwise, as viewed in FIG. 3, in unison with the clockwise rotation of the upper roller 41. The lower roller 42, in turn, causes the other lower roller 44 to rotate in the same direction via the lower belt 46.

The lower roller 42 is angularly movable about the axis of the upper roller 41 in the right-and-left direction in FIG. 3. The lower roller 42 is moved, at a preselected timing, from a position indicated by a solid line to a position indicated by a dash-and-dots line by drive means not shown. At the dash-and-dots line position, the lower roller 42 contacts the ink drum 89*a*. In this manner, the lower roller 42 is selectively movable into or out of contact with the ink drum 89*a*.

The waste master box 47 is positioned downstream of the upper roller 43 and lower roller 44. The compression plate 48 is positioned above the box 47 and moved up and down by elevating means not shown. The used master, labeled 94*a*, is nipped by the upper roller 41 and lower roller 42 and conveyed to the left, as viewed in FIG. 3, thereby. Then, the used master 94*a* is introduced into the box 47. Thereafter, the compression plate 48 is lowered from the position shown in FIG. 3 in order to compress the used master 94*a*. The box 47 can be pulled out of the printer A to the left in FIG. 3 in order to discard a suitable number of used masters 94*a* compressed by the compression plate 48.

Figure 4:
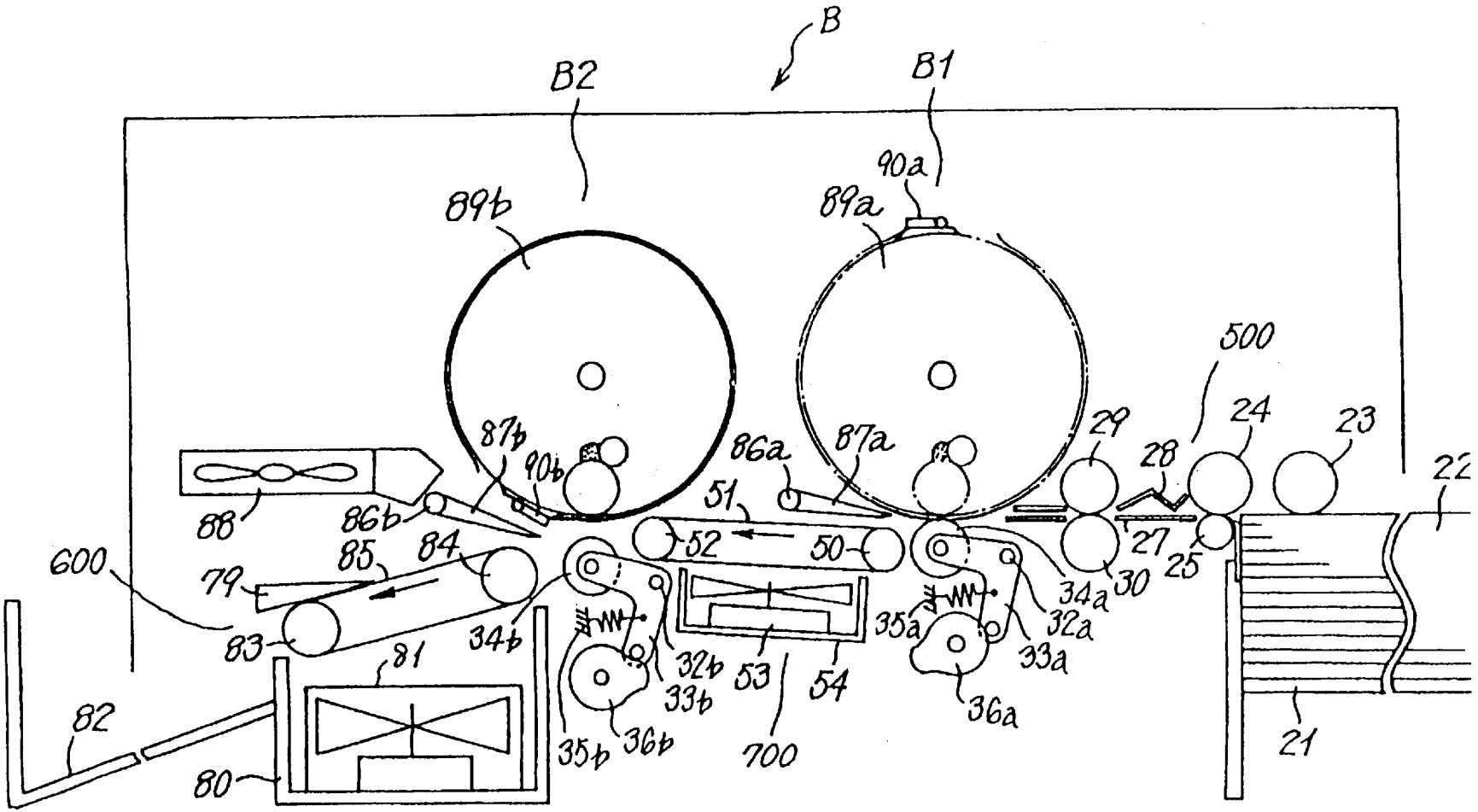
FIG. 4 is a front view of the printer playing the role of a multicolor printer.

Reference will be made to FIG. 4 for describing a specific configuration of the printer B. As shown, the printer allows the two ink drums 89*a* and 89*b* to be mounted to its center portion side by side. A paper feeding device 500 is positioned below and at the right-hand side of the ink drum 89*a*. A press roller 34*a* and a peeler 87*a* are located below the ink drum 89*a* while a press roller 34*b* and a peeler 87*b* are located below the ink drum 89*b*. An intermediate paper conveyor 700 intervenes between the ink drums 89*a* and 89*b*. A paper conveyor 600 is arranged below and at the left-hand side of the ink drum 89*b*. A fan 88 for sending air is positioned at the left-hand side of the peeler 87*b*. A tray 82 for stacking printings is located at the left-hand side of the paper conveyor 600.

The ink drum 89*b* is identical in configuration as the ink drum 89*a* and will not be described in order to avoid redundancy. Also, the paper feeding device 500, press rollers 34*a* and 34*b*, paper conveyor 600, peelers 87*a* and 87*b*, fan 88 and tray 82 each is identical in configuration with the corresponding member of the printer A and will not be described specifically.

The intermediate paper conveyor 700 includes a drive roller 52, a driven roller 50, a belt 51 passed over the drive roller 52 and driven roller 50, a suction fan 53, and a casing 54. The belt 51 is rotatable at a linear velocity equal to or slightly higher than the linear velocity of the ink drum 89*a*.

The leading edge of the paper 22 being printed with an image by the ink drum 89*a* is separated from the drum 89*a* by the peeler 87*a* and drops onto the right end portion of the belt 51, as viewed in FIG. 4. At the same time, the leading edge of the paper 22 is brought into close contact with the upper run of the belt 51 by the suction fan 53 sucking air downward in FIG. 4. For this purpose, the belt 51 is formed with a plurality of apertures. The suction is further promoted by vacuum generated in the casing 54 by the suction fan 53.

At least the surface of the belt 51 is formed of urethane rubber or similar material having a high coefficient of friction in relation to the paper 22. The belt 51 therefore exerts a force drawing the paper 22 to the left in FIG. 4. At this stage, however, the paper 22 is moved to the left at a speed equal to the peripheral speed of the ink drum 89*a* because the upstream side of the paper 22 in the direction of paper feed is still nipped between the the drum 89*a* and the press roller 34*a*. The linear velocity of the belt 51 is equal to or slightly higher than the peripheral speed of the ink drum 89*a*, as stated earlier, so that the paper 22 is conveyed under tension to the left in FIG. 4.

The arrangement between the print position or nip where the ink drum 89*b* assigned to the second color is positioned and the tray 82 is identical with the arrangement of the printer A and will not be described in order to avoid redundancy.

The operation of the multicolor printing system will be described in detail with reference to FIGS. 3 and 4. Let two colors to be dealt with by the system be black and red by way of example.

First, the operator mounts the ink drum 89*a* storing black ink to the printer A, lays a document 1 for black printing on the ADF 2 or the glass platen 3, and then presses a perforation start button not shown. In response, the master discharging device 400 discharges a used master 94*a* existing on the ink drum 89*a*. Specifically, the ink drum 89*a* starts rotating counterclockwise by being driven by drive means not shown. When the ink drum 89*a* reaches a preselected master discharge position where the trailing edge of the used master 94*a* not clamped by the damper 90 faces the upper roller 41, moving means and drive means, not shown, cause the upper roller 41 and lower roller 42 to rotate in the directions indicated by arrows in FIG. 3 while moving the lower roller 42 to the dash-and-dots line position of FIG. 3.

At the time when the lower roller 42 contacts the trailing edge portion of the used master 94*a*, the ink drum 89*a* is still rotating counterclockwise with the result that the roller 42 picks up the trailing edge of the master 94*a*. The upper roller 41 and lower roller 42 nip the master 94*a* and convey it to the left in FIG. 3. As a result, the master 94*a* is removed from the ink drum 89*a*. The upper belt 45 and lower belt 46 in rotation further convey the master 94*a* to the left.

After the master 94*a* has been entirely received in the waste master box 47, the compression plate 48 is lowered to compress the master 94*a*.

After the removal of the entire used master 94*a* from the ink drum 89*a*, the ink drum 89*a* is further rotated until the damper 90 reaches a master feed position (FIG. 3) adjoining a guide 68. When the ink drum 89*a* stopped at the master feed position, opening and closing means, not shown, causes the damper 90 to rotate clockwise away from the stage and wait for a new master. This is the end of the master discharging operation.

A master making operation begins substantially at the same time as the above master discharging operation, as follows. The document 1 is conveyed by the ADF 2 from the stacking position to the reading position and illuminated by the lamp 4 at the reading position. The resulting imagewise reflection from the document 1 is routed through the mirrors 5 and 6 and lens 7 to the CCD image sensor 8. The image sensor 8 transforms the incident imagewise light to a corresponding electric signal and feeds the electric signal to the image processing circuit not shown. The document 1 fully read by the document reading section 200 is driven out to a tray 9 by the ADF 2. In parallel with the image reading operation, a plurality of heating elements arranged on the thermal head 63 are selectively energized in accordance with a digital image signal output from the image processing circuit. At the same time, the platen roller 71 and tension rollers 66 and 67 are caused to rotate by the drive means not shown.

The stencil 94 paid out from the roll 61 is perforated by the thermal head 63 while being conveyed by the platen roller 71. The tension rollers 66 and 67 convey the leading edge of the perforated part of the stencil 94 toward the clamper 90 held in the dash-and-dots line position shown in FIG. 3. When the number of steps of the stepping motor driving the platen roller 71 reaches a preselected number, i.e., when the stencil 94 is fed by a preselected length, it is determined that the leading edge of the stencil 94 has reached the space between the damper 90 and the stage. As a result, the damper 90 is closed by the opening and closing means, not shown, so as to clamp the leading edge of the stencil 94. Thereafter, the ink drum 89*a* is caused to rotate clockwise in order to wrap the perforated stencil 94 therearound.

As soon as the perforated stencil 94 is wrapped around the ink drum 89*a* by a preselected length, the drum 89*a*, platen roller 71 and tension rollers 66 and 67 are caused to stop rotating. At the same time, a motor, not shown, causes the rotary edge 64 to move in the previously mentioned direction in order to cut the stencil 94 in cooperation with the stationary edge 65. Then, the ink drum 89*a* is again rotated clockwise in order to pull the trailing edge of the cut piece of the stencil, i.e., the master 94 out of the master making device 300. By such a procedure, the master 94 is fully wrapped around the ink drum 89*a*.

After the above master feeding step, the ink drum 89*a* is rotated clockwise by the drive means. The pick-up roller 23 feeds only the top paper 22 on the tray 21 in cooperation with the upper and lower separator rollers 24 and 25. The paper 22 is fed to the registration rollers 29 and 30 along an upper guide 28 and a lower guide 27. The registration rollers 29 and 30 drive the paper 22 toward the gap between the press roller 34 and the ink drum 89*a* at a preselected timing.

The press roller 34 is angularly moved about the shaft 32 in accordance with the rotation of the cam 36 and presses the paper 22 against the master 94 wrapped around the ink drum 89*a*. At this instant, the ink, or emulsion ink, is fed to the inner periphery of the porous thin plate of the ink drum 89*a* while being measured by the gap between the ink roller 92 and the doctor roller 91. Then, the ink penetrates into the porous elastic layer of the ink drum 89*a* via the perforations of the porous thin plate due to an wedge effect available between the outer periphery of the ink roller 92 and the inner periphery of the porous thin plate. The ink further spreads from the porous elastic layer into the porous support of the master 94. Finally, the ink is transferred to the paper 22 via the perforations of the master film, printing a document image on the paper 22. The paper with the image or printing 22 is peeled off from the ink drum 89*a* by the peeler 87 and fan 88 and conveyed to the paper conveyor 600.

In the paper conveyor 600, the belt 85 is rotating in the direction indicated by the arrow in FIG. 3, as stated earlier. The paper or printing 22 is conveyed by the belt 85 while being retained on the belt 85 by the suction fan 81. The printing 22 is driven out onto the tray 82 due to elasticity provided by the jump platform 79. In practice, two jump platforms are positioned at both ends in the widthwise direction of the paper 22, i.e., in the direction perpendicular to the sheet surface of FIG. 3. During such a procedure, the master 94 is pressed against the ink drum 89*a* by the press roller 34 via the paper 22 and brought into close contact with the drum 89*a* thereby.

By checking the printing 22 driven out onto the tray 82 by the above trial printing, the operator determines whether or not the image of the printing 22 is acceptable. If the image is not acceptable, then the operator may cause the printer A to repeat the above master making step. Further, while the ink drum 89*a* is present in the printer A, the operator may input a desired number of printings and other conditions and then press the print start switch, not shown, on the printer A. In such a case, the print drum 89*a* will be rotated by the drive means, not shown, so as to produce the desired number of black printings 22.

After the trial printing, the operator removes the ink drum 89*a* with the new master 94 from the printer A and then mounts it to the drum mounting section B1 of the printer B. Subsequently, the operator removes the ink drum 89*b* storing red ink from the drum mounting section B2 of the printer B and mounts it to the printer A. Then, the operator lays the document 1 for red printing on the ADF 2 or the glass platen 3 and presses the perforation start button. In response, the master discharging device 400 discharges a used master 94*a* existing on the ink drum 89*b*. This is followed by the same procedure as executed with the ink drum 89*a* with the result that a new master formed with a perforation pattern representative of a red image is wrapped around the ink drum 89*b*. This procedure will not be described specifically in order to avoid redundancy.

The operator removes the ink drum 89*b* with a master wrapped therearound from the printer A and then mounts it to the drum mounting section B2 of the printer B. The printer B is now ready to effect bicolor printing with the two ink drums 89*a* and 89*b* each carrying a particular master.

A bicolor printing procedure available with the printer B is as follows. When the operator inputs a desired number of printings on the printer B and presses the print start key, the ink drums 89*a* and 89*b* are rotated clockwise in unison by the drive means not shown. The pick-up roller 23 feeds only the top paper 22 on the tray 21 in cooperation with the upper and lower separator rollers 24 and 25. The paper 22 is fed to the registration rollers 29 and 30 along an upper guide 28 and a lower guide 27. The registration rollers 29 and 30 drive the paper 22 toward the gap between the press roller 34*a* and the ink drum 89*a* in synchronism with the rotation of the ink drum 89*a* and that of the ink drum 89*b*. The press roller 34*a* is angularly moved about the shaft 32*a* in accordance with the rotation of the cam 36*a* so as to presses the paper 22 against the master 94 wrapped around the ink drum 89*a*. As a result, a black image is printed on the paper 22.

The leading edge of the paper 22 being printed with the black image by the ink drum 89*a* is separated from the drum 89*a* by the peeler 87*a* and conveyed toward the intermediate paper conveyor 700. At this instant, the belt 51 is rotating in the direction indicated by the arrow in FIG. 4. The leading edge of the paper 22 is easily sucked onto the belt 51 by vacuum generated in the casing 54 by the suction fan 53. The belt 51 exerts a force drawing the paper 22 to the left in FIG. 4. Although the belt 51 moves at a linear velocity equal to or slightly higher than the linear velocity of the ink drum 89*a*, as stated earlier, the the paper 22 is moved to the left at a speed equal to the peripheral speed of the ink drum 89*a* because the upstream side of the paper 22 in the direction of paper feed is still nipped between the the drum 89*a* and the press roller 34*a*. As a result, the paper 22 is conveyed under tension to the left in FIG. 4. More specifically, the linear velocity of the belt 51 is higher than the speed at which the paper 22 is conveyed, so that the belt 51 and paper 22 slip on each other.

The leading edge of the paper 22 enters the nip between the ink drum 89*b* and the press roller 34*b* while being drawn by the belt 51. The press roller 34*b* is brought into contact with the ink drum 89*b* at a preselected timing and pressed against the drum 89*b* by the spring 35*b*. Specifically, while the press roller 34*b* is usually spaced from the ink drum 89*b* so as not to interfere with the damper 90*b* of the drum 89*b*, it is brought into contact with the drum 89*b* before the leading edge of the paper 22 arrives.

The ink drums 89*a* and 89*b* are interlocked by a driveline, not shown, such that they rotate at the same peripheral speed. However, a preselected difference in initial phase is set between the ink drums 89*a* and 89*b* beforehand such that a black image and a red image coincide on the paper 22. The above difference is implemented by a difference in position between the dampers 90*a* and 90*b*, as shown in FIG. 4. The angular distance between the dampers 90*a* and 90*b* is equal to a center angle translated from a conveyance distance between the print position of the ink drum 89*a* and that of the ink drum 89*b*, as measured on the circumference of the ink drum 89*b*. The above conveyance distance is substantially equal to a distance between the axis of the ink drum 89*a* and that of the ink drum 89*b*.

Figure 5A:
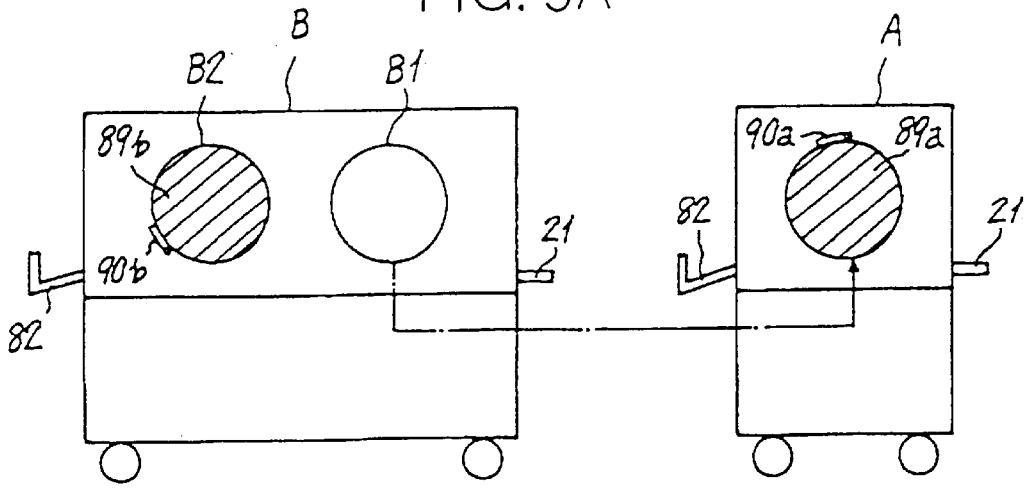
FIGS. 5A–5C show how the ink drums included in the system of FIG. 1 are mounted and dismounted in an identical angular position.
Figure 5B:
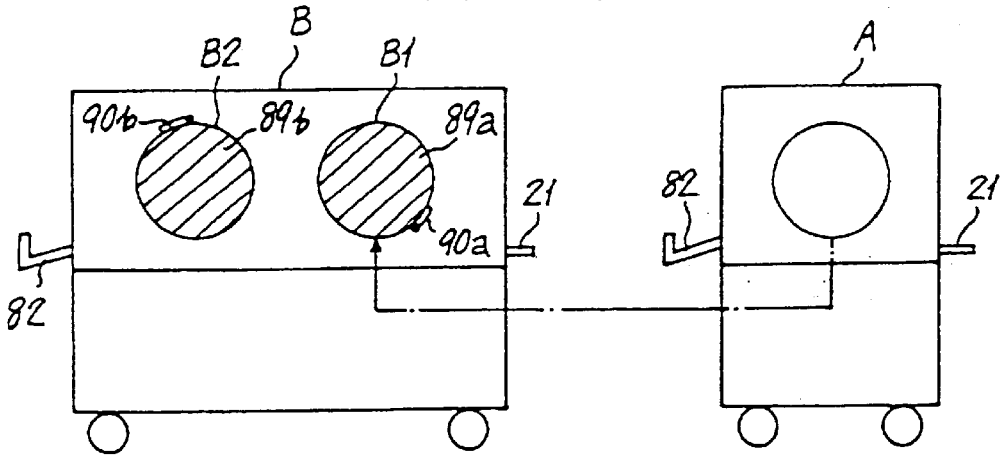
Figure 5C:
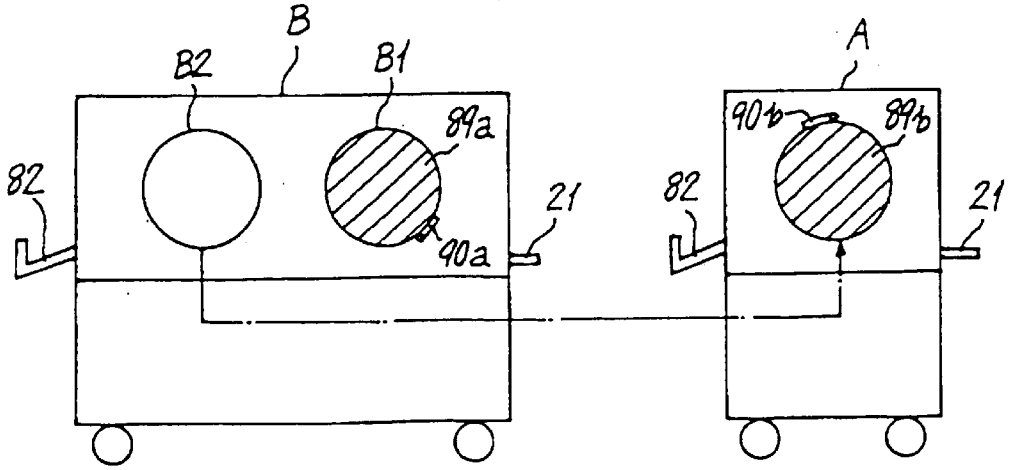

However, the ink drums 89*a* and 89*b* are mounted and dismounted from the printers A and B in the same angular position. This is also true in the other embodiments to be described later. In the illustrative embodiment, as shown in FIGS. 5A–5C, the ink drums 89*a* and 89*b* each can be mounted or dismounted only when its damper 90*a* or 90*b* is positioned on the top of the drum. Specifically, FIG. 5A shows a condition wherein the ink drum 89*a* is removed from the drum mounting section B1 when its damper 90*a* is positioned on the top, and then mounted to the printer A with the damper 90*a* also positioned on the top. When the drums 89*a* and 89*b* each is dismounted, its angular position is affixed by a respective device not shown. This allows each of the drums 89*a* and 89*b* to be mounted in the same angular position as when it is dismounted.

More specifically, to dismount the ink drum 89*b*, after the ink drum 89*a* has been returned to the drum mounting section B1 from the position shown in FIG. 5A, the ink drum 89*b* is rotated until its damper 90*b* has been positioned on the top of the drum 89*b* (FIG. 5B). Then, the ink drum 89*b* is removed from the drum mounting section B2 and then mounted to the printer A (FIG. 5C).

It is to be noted that the dampers 90*a* and 90*b* do not have to be positioned on the top of the associated ink drums 89*a* and 89*b* when the drums 89*a* and 89*b* are mounted and dismounted. The crux is that the angular positions of the clampers 90*a* and 90*b* at the time of mounting and dismounting be identical throughout the system.

In the above construction, a red image is printed on the paper 22 at the nip between the ink drum 89*b* and the press roller 34*b* at the same position as the black image existing on the paper 22.

In the illustrative embodiment, the ink drums 89*a* and 89*b* are driven in interlocked relation to each other, as stated above. If desired, use may be made of a conventional phase adjusting mechanism PA for adjusting the position of a red image relative to the position of a black image in the direction of paper feed (top-and-bottom direction), as taught in, e.g., Japanese Patent Laid-Open Publication No. 9-104158 mentioned earlier. When the system includes three or more ink drums, a particular phase adjusting mechanism PA will be associated with each downstream ink drum and will act on an upstream ink drum immediately preceding the downstream drum.

When the positions where the ink drums 89*a* and 89*b* clamp the respective masters 94 in the printer A are deviated from each other, the above phase adjusting mechanism PA allows the printer B to correct the deviation.

Assume that the red image is deviated in position from the black image in the direction perpendicular to the direction of paper feed (right-and-left direction). Then, the position of the paper 22 is adjusted. Alternatively, a mechanism for shifting the ink drum in the axial direction is used to shift the red image relative to the black image in the direction perpendicular to the direction of paper feed.

When the red image is printed on the paper 22 by the pressure of the press roller 34*b*, the leading edge of the paper 22 is separated from the ink drum 89*b* by the peeler 87*b* and fan 88 and further moved to the paper conveyor 600. In the paper conveyor 600, the belt 85 rotating in the direction indicated by the arrow in FIG. 4 conveys the paper or printing 22. At this instant, the suction fan 81 sucks the printing 22 and thereby retains it on the belt 85, as stated earlier. Subsequently, the paper 22 is driven out onto the tray 82 via the jump platforms 79. The belt 85 is caused to move at a peripheral speed equal to or slightly higher than the peripheral speed of the ink drum 89*b*.

As stated above, the paper 22 is sequentially passed through the print positions assigned to the ink drums 89*a* and 89*b* storing black ink and red ink, respectively. As a result, the black image and red image are printed on a single paper 22 one above the other. Thereafter, a desired number of printings are produced in the same manner. On the completion of the printing operation, the press rollers 34*a* and 34*b* are held in their positions spaced from the ink drums 89*a* and 89*b*, respectively.

To print the image of another document, the operator again dismounts each of the ink drums 89*a* and 89*b* from the printer B and mounts it to the printer A so as to wrap a new master 94 therearound. Then, the operator mounts each of the ink drums 89*a* and 89*b* carrying the respective new masters to the printer B and presses the print start key on the printer B. The printers A and B each is caused to operate in the above-described manner by a respective drive mechanism and control means not shown.

The printers A and B can be situated independently of each other. The illustrative embodiment therefore enhances free layout while realizing noticeable downsizing due to the shared master making device. The downsizing feature is achievable even when the printers A and B are constructed integrally with each other.

The master making device has been shown and described as being implemented by the conventional single drum type stencil printer A. If desired, the printer may be replaced with a simple master making device void of the printing function. This further enhances the downsizing feature of the entire system.

In the illustrative embodiment, the ink drums 89*a* and 89*b* each is mounted to a particular drum mounting section of the printer B. This, however, limits the tones which can be rendered by multicolor printing. In light of this, an arrangement may be made such that the ink drums 89*a* and 89*b* each can be mounted to any desired drum mounting section, i.e., different colors can be printed on the paper 22 in any desired order. Such an alternative arrangement enhances the freedom of color reproduction.

The above embodiment uses only two ink drums for bicolor printing. If four ink drums, for example, are prepared, then new masters can be wrapped around two of the drums in the printer A for one printing job while another printing job is under way with the other two drums in the printer B. This promotes efficient printing work to a noticeable degree.

The printers A and B may be connected by any suitable communication means in order to improve the manipulability of the system. The communication means allows the printer A to be operated via the printer B or allows the printers A and B to be operated via each other.

Because a single master making device fixedly arranged in the printer A is shared by the ink drums 89*a* and 89*b*, registration errors is obviated.

The system allows different ink drums to be replaced with each other. Therefore, even when the multicolor printer accommodates only two ink drums, three or more ink drums each storing ink of particular color can be used. This allows various kinds of images to be printed.

When two ink drums both store black ink, they may be respectively assigned to a photo image and a text image so as to produce a combined photo/text image.

A document image may be input to the printer A not only via the document reading device, but also via a personal computer.

The press roller implementing the pressing means of each of the printers A and B may be replaced with a conventional press drum.

The thermal head included in the printer A for making a master may be replaced with any other suitable perforating means, e.g., a flash or a laser.

The black ink and red ink are only illustrative. The illustrative embodiment allows, e.g., the black ink to be readily replaced with blue ink in order to product a blue-and-red printing. Further, the illustrative embodiment is capable of producing a multicolor printing with ink of different kinds available from different manufacturers although they may be of the same color. Of course, the system is operable with ink of the same color available from the same manufacturer. One ink drum 89*a* may be assigned to a fixed document while the other ink drum 89*b* may be assigned to other documents including a document with an image to be combined or mixed with the image of the fixed document.

It will be seen from the above that the words "multicolor printing" referred to in the illustrative embodiment is not limited to printing using two or more colors.

Figure 6:
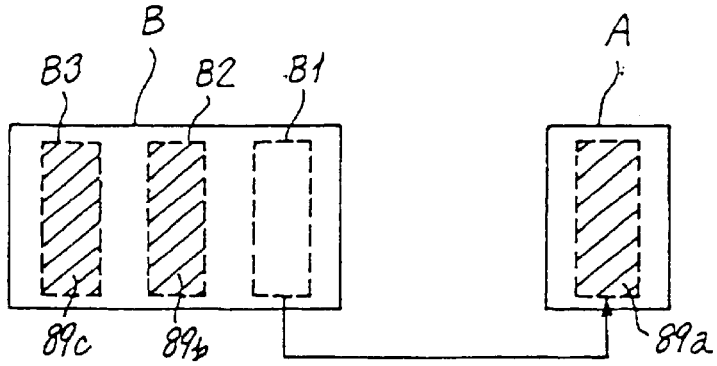
FIG. 6 demonstrates how a multicolor printing system with a multicolor printer including three print drums is used.
Figure 7:
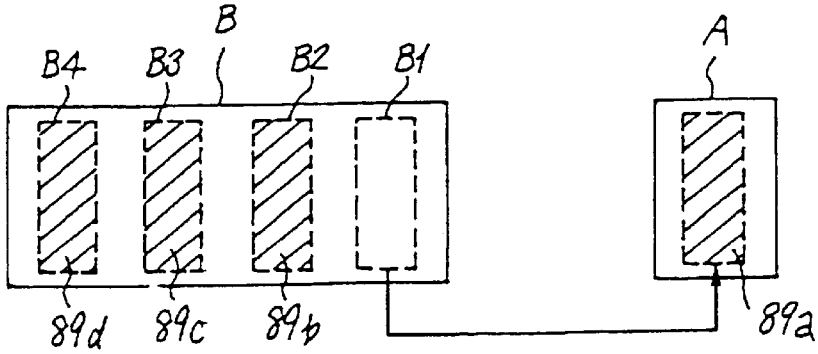
FIG. 7 demonstrates how a multicolor printing system with a multicolor printer including four print drums is used.

FIGS. 6 and 7 show an alternative embodiment of the present invention implemented as a multicolor printer B operable with three or four ink drums.

Figure 8:
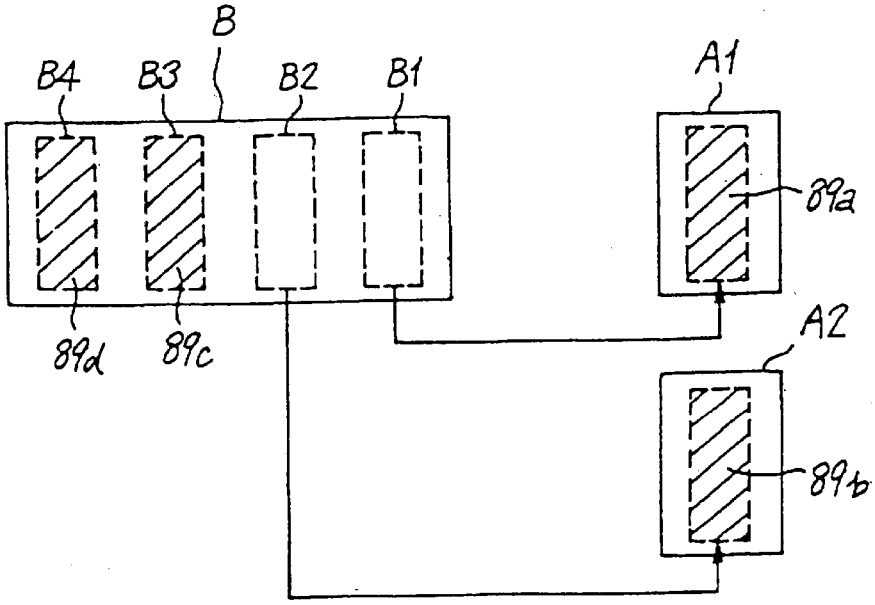
FIG. 8 demonstrates how a multicolor printing system with four ink drums and two master making devices is used.

FIG. 8 shows another alternative embodiment of the present invention including printers A1 and A2 each being capable of making a master with a particular system. The printers A1 and A2 respectively use a thermal head and a laser by way of example. In this embodiment, the print drum 89*a* stores ink suitable for master making using the thermal head is mounted to the printer A1 and supplied with a master for the same kind of master making. The other print drum 89*b* stores ink suitable for master making using the laser is mounted to the printer A2 and supplied with a master for the same kind of master making. This is also true with the other ink drums 89*c* and 89*d*. This embodiment operable with ink of different kinds and masters of different kinds allows various kinds of images to be printed.

In the above embodiments, the printer B is void of the master making and master discharging functions for enhancing the downsizing feature of the entire system. If the downsizing feature is not important, then the printer B may, of course, be provided with suitable arrangements for making and discharging a master in order to reduce the operator's labor, as follows.

Figure 9:
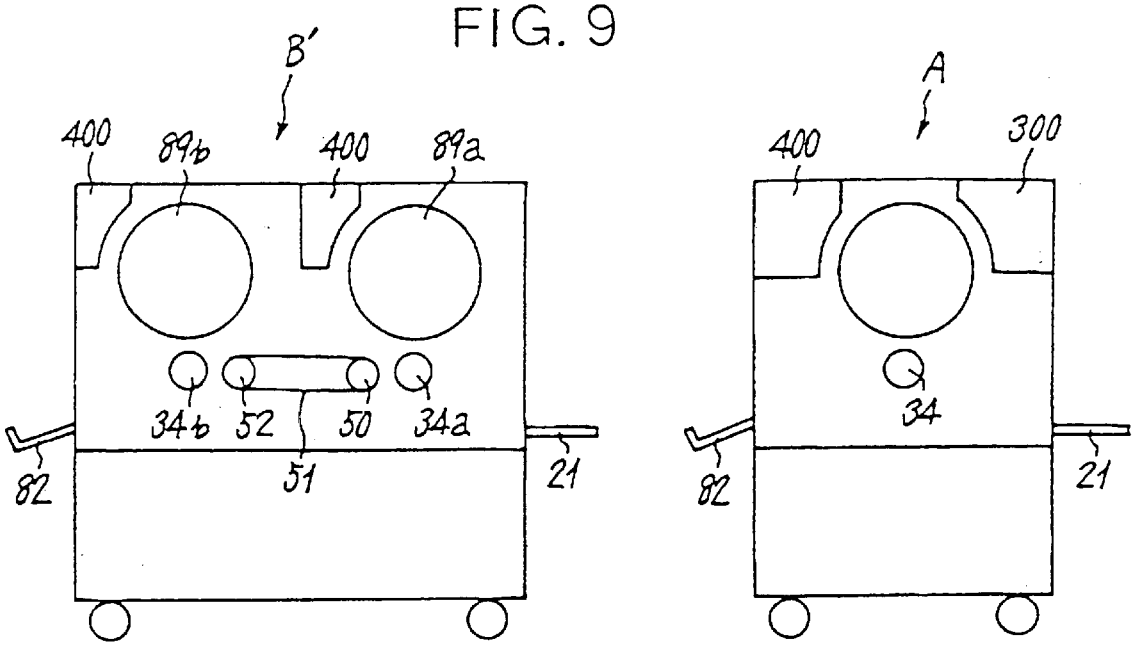
FIG. 9 is a front view of a multicolor printing system in which the multicolor printer includes a master discharging device.

FIG. 9 shows another alternative embodiment of the present invention implementing the above scheme. As shown, a printer B' which is a substitute for the printer B includes two master discharging devices 400 respectively assigned to the ink drums 89*a* and 89*b*. The other printer A is identical in construction as in the previous embodiments. Although the addition of the master discharging devices 400 reduces the downsizing effect, this embodiment allows used masters to be discharged from the ink drums 89*a* and 89*b* before the dismounting of the drums 89*a* and 89*b*. The printer A should therefore only make masters and feed them to the ink drums 89*a* and 89*b*. This not only reduces the time up to the start of printing, but also reduces the operator's labor for mounting and dismounting the ink drums 89*a* and 89*b*.

Reference will be made to FIGS. 10 and 11A–11D for describing another alternative embodiment of the present invention. While the systems shown and described each includes two independent stencil printers and allows different ink drums to be mounted and dismounted therefrom, the system to be described hereinafter allows the drums to be replaced within a single construction. That is, in this embodiment, the printer A is combined with the printer B of the embodiment described first.

Figure 10:
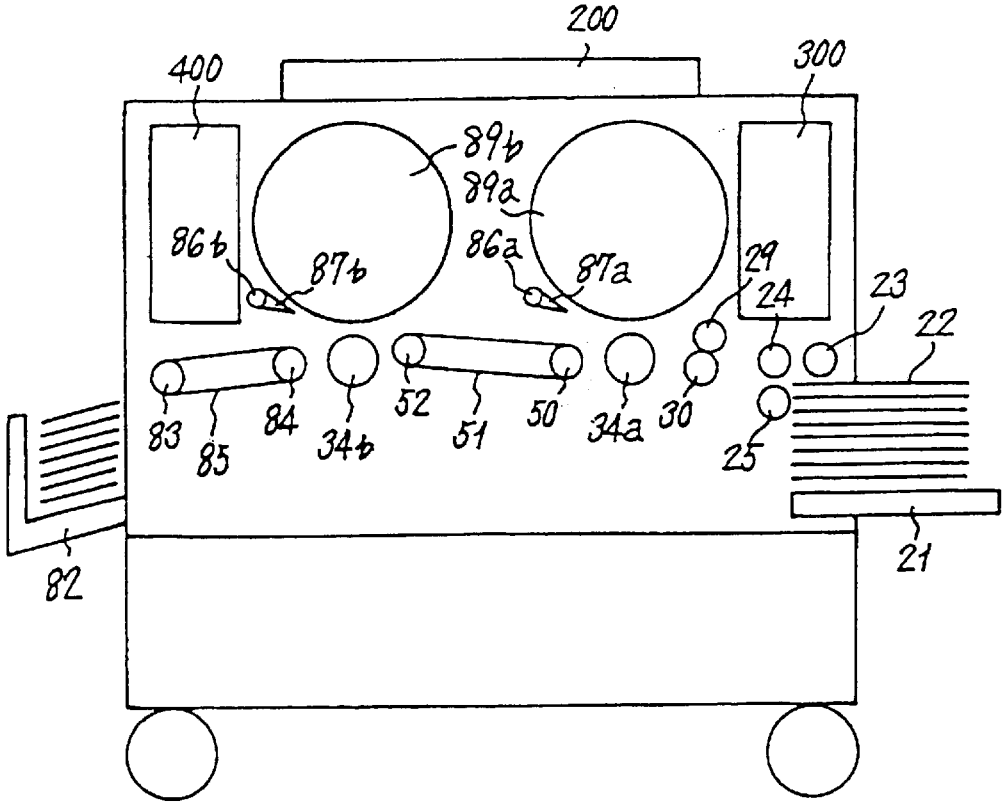
FIG. 10 is a front view showing a multicolor printing system in which ink drums are replaced in a single construction.

As shown in FIG. 10, a multicolor printing system includes the document reading section 200 including an ADF, two ink drums 89*a* and 89*b*, master making device 300, master discharging device 400 and so forth in a single construction. The master making device 300 and master discharging device 400 are respectively located in the vicinity of the ink drum 89*a* for the first color and the ink drum 89*b* for the second color for the downsizing purpose.

Figure 11A:
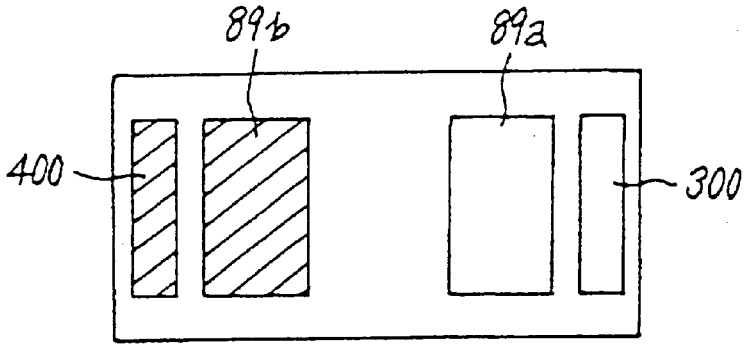
FIGS. 11A–11D are plan views showing a master discharging procedure and a master feeding procedure particular to the system of FIG. 10.
Figure 11B:
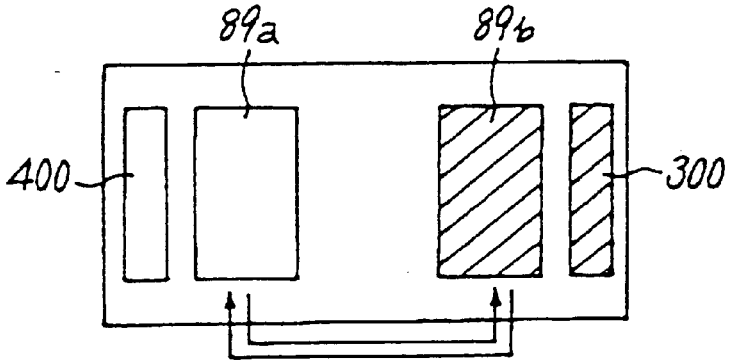

Referring to FIGS. 11A–11D, a master feeding procedure and a master discharging procedure particular this embodiment will be described. First, as shown in FIG. 11A, a used master existing on the ink drum 89*b* is discharged by the master discharging device 400. Then, as shown in FIG. 11B, the ink drums 89*a* and 89*b* are replaced with each other. After a new master has been wrapped around the ink drum 89*b* by the master making device 300, a single printing is produced in order to cause the master to adhere to the drum 89*b*.

Figure 11C:
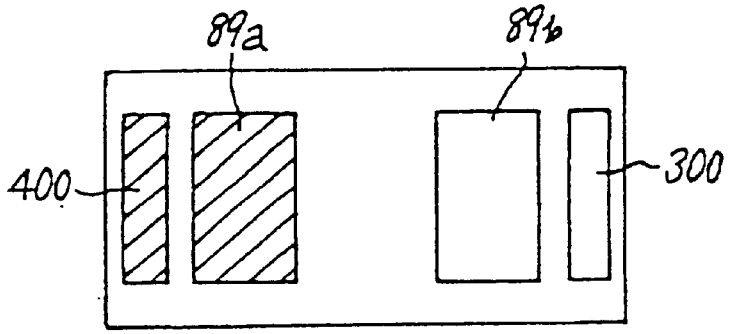
Figure 11D:
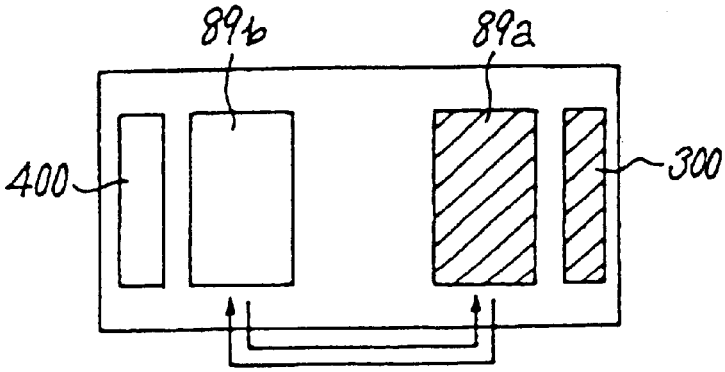

Subsequently, as shown in FIG. 11C, a used master existing on the ink drum 89*a* is discharged by the master discharging device 400. Thereafter, as shown in FIG. 11D, the ink drums 89*a* and 89*b* are replaced with each other so as to cause the master making device 300 to wrap a new master around the drum 89*a*, and then another printing is produced for the same purpose as the first printing. The step of feeding a new master to the ink drum 89*b* (FIG. 11B) and the step of discharging a used master from the ink drum 89*a* (FIG. 11C) may be effected at the same time. However, the prerequisite with such an alternative scheme is that the press roller 34*b* be not raised at the time when a single printing is produced for causing the new master to adhere to the ink drum 89*b*. Should the press drum 34*b* be raised in the absence of a master on the ink drum 89*a*, it would be smeared by ink. This is also true with embodiments to follow. After the above procedure, the system starts producing a desired number of printings. This embodiment insures accurate registration as to master making and obviates troublesome adjustment because a single master making device 300 is shared by the ink drums 89*a* and 89*b*.

Figure 12:
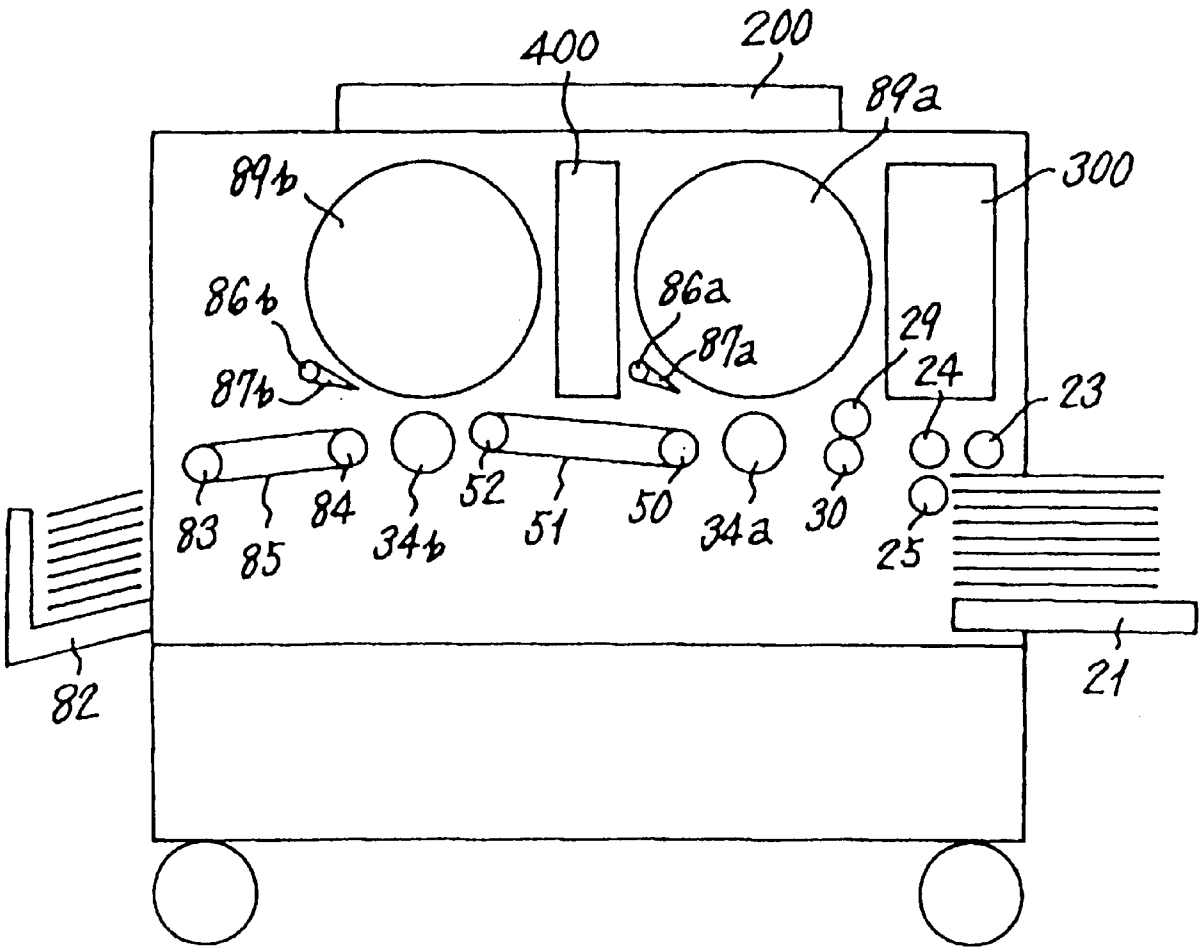
FIG. 12 is a front view showing a modification of the multicolor printing system of FIG. 10.
Figure 13A:
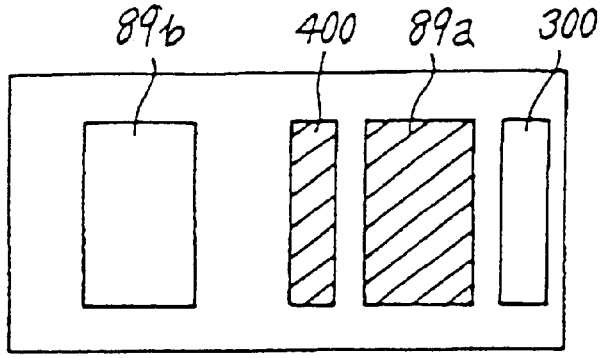
FIGS. 13A–13D are plan views showing a master discharging procedure and a master feeding procedure particular to the system of FIG. 12.
Figure 13B:
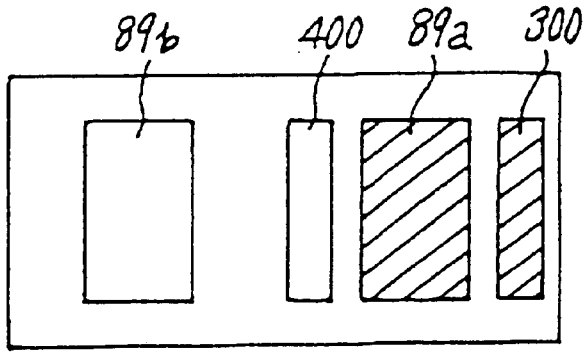
Figure 13C:
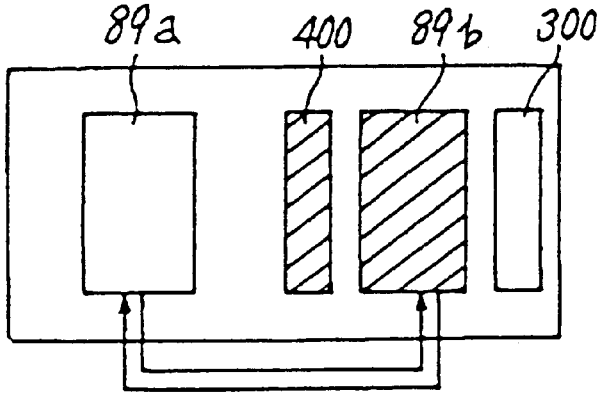
Figure 13D:
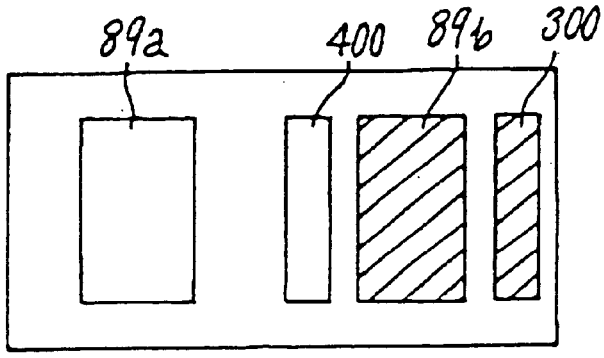

FIG. 12 shows a modification of the system shown in FIG. 10. The modification differs from the embodiment of FIG. 10 in that the master making device 300 and master discharging device 400 are associated with the ink drum 89*a* assigned to the first color. A master feeding procedure and a master discharging procedure particular to the modification will be described with reference to FIGS. 13A–13D. First, as shown in FIG. 13A, the master discharging device 400 discharges a used master from the ink drum 89*a*. Then, as shown in FIG. 13B, the master making device 300 feeds a new master to the ink drum 89*a*. This is followed by trial printing for producing a single printing. Thereafter, as shown in FIG. 13C, the ink drum 89*b* is substituted for the ink drum 89*a*. In this condition, a used master is removed from the ink drum 89*b*. Subsequently, as shown in FIG. 13D, a new master is fed to the ink drum 89*b* by the master making device 300. This is also followed by trial printing for producing a single printing. After the trial printing, the actual printing operation begins.

The above modification has an advantage that the ink drums 89*a* and 89*b* should be replaced with each other only once, compared to the embodiment shown in FIG. 10. Of course, the ink drums 89*a* and 89*b* shown in FIG. 13D may be replaced with each other before the start of actual printing.

Figure 14:
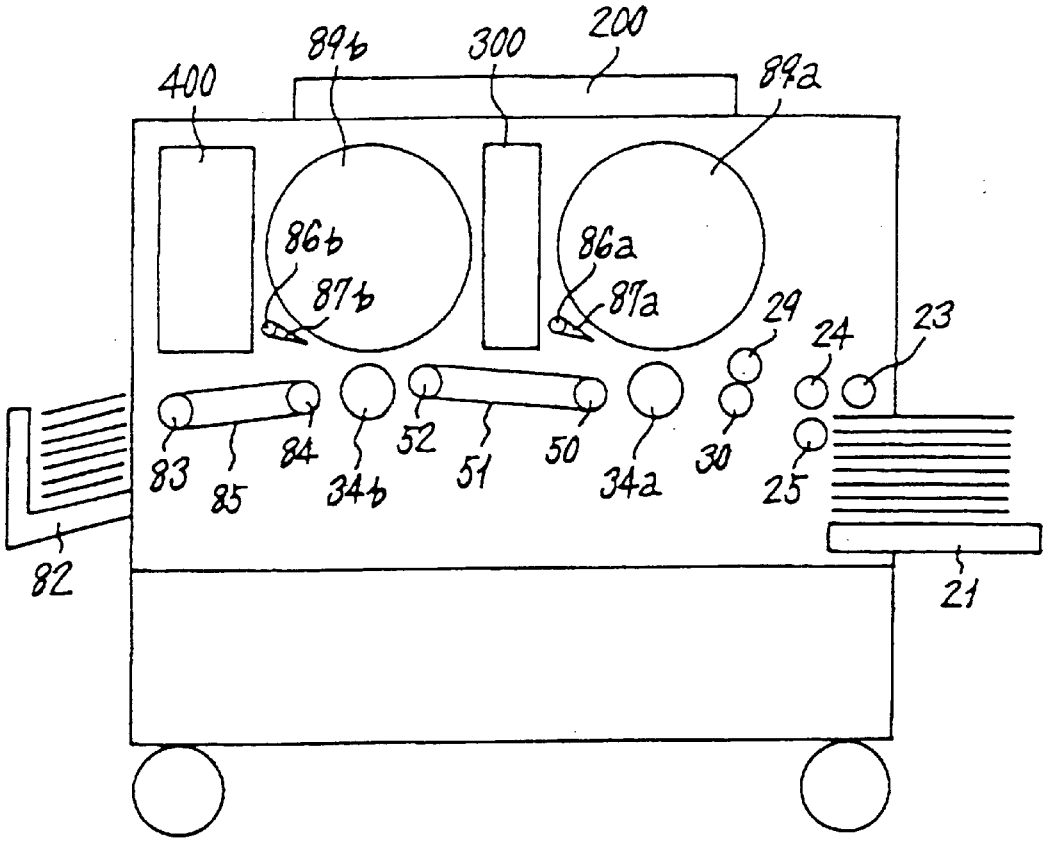
FIG. 14 is a front view showing another modification of the multicolor printing system of FIG. 10.

FIG. 14 shows another modification of the embodiment of FIG. 10. As shown, the master making device 300 and master discharging device 400 are associated with the ink drum 89*b* assigned to the second color. This modification is identical in function as the modification shown in FIG. 12.

Other alternative embodiments of the present invention will be described with reference to FIGS. 15–22. The embodiments to be described each has a plurality of independent devices connected together to constitute a single system.

Figure 15:
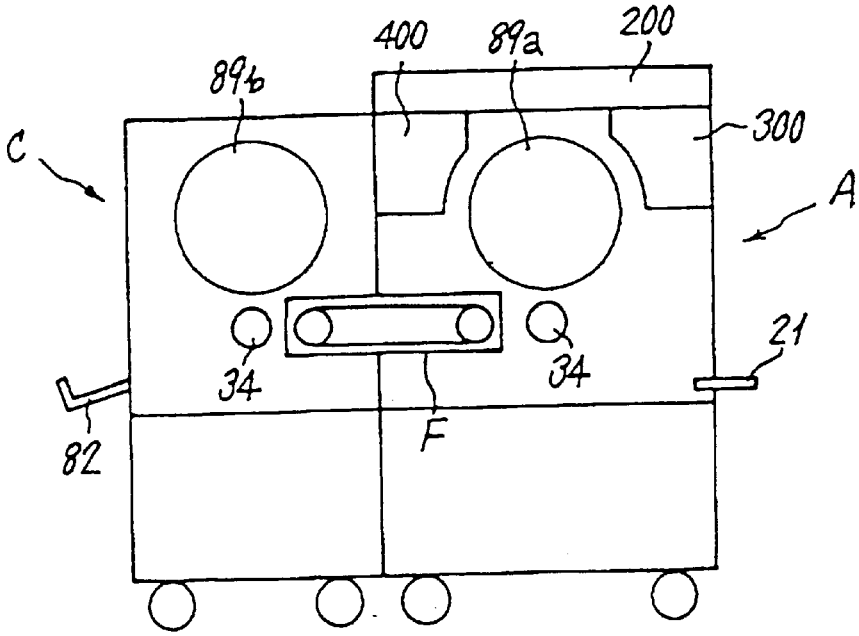
FIG. 15 is a front view showing a serial connection type multicolor printing system.
Figure 16:
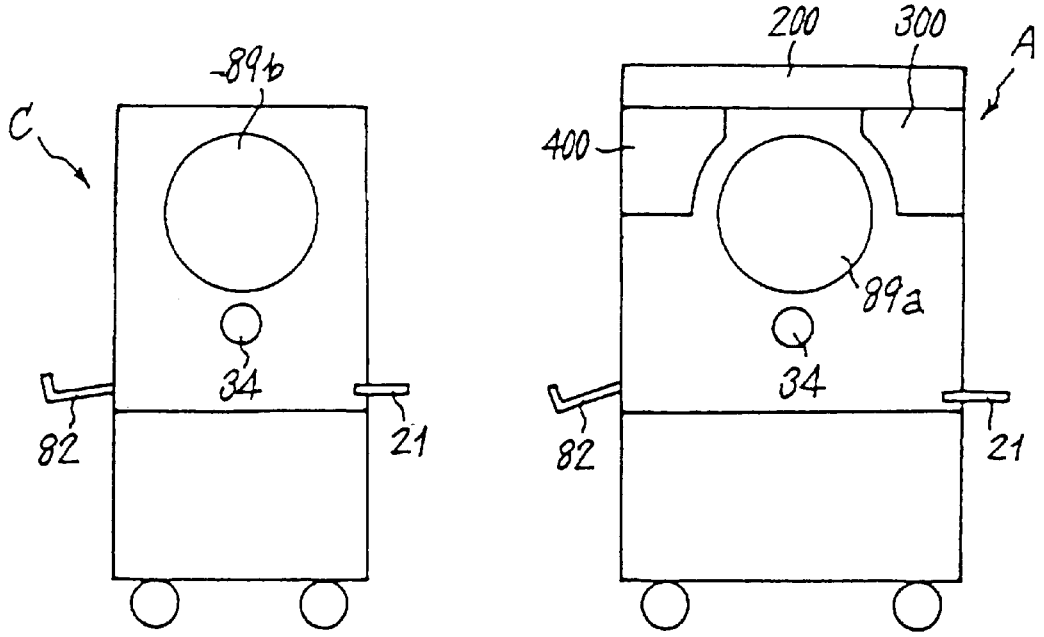
FIG. 16 is a front view showing the system of FIG. 15 in a separated condition.

FIG. 15 shows an embodiment in which the stencil printer or main printer A included in the first embodiment and a stencil printer or auxiliary printer C identical with the stencil printer B except that it includes only one ink drum 89*b*. The two printers A and C are connected to each other by an intermediate conveyor unit F. The two printers A and C are originally separate from each other, as shown in FIG. 16. In this embodiment, the printer A is fixedly loaded with the ink drum 89*a*. The printers A and C each includes an arrangement for mounting and dismounting the intermediate conveyor unit F, although not shown specifically. This is true with the other embodiments to follow.

To connect the two printers A and C, the tray 82 of the printer A and the tray 21 of the printer C are removed, and then the printers A and C are connected together by the intermediate conveyor unit F. After the system has been constructed, the intermediate conveyor unit F plays the role of the intermediate paper conveyor 700 of the printer B included in the first embodiment. A master making procedure and a master discharging procedure to be executed with the ink drums 89*a* and 89*b* and the advantage achievable therewith are the same as in the first embodiment and will not be described in order to avoid redundancy.

Figure 17:
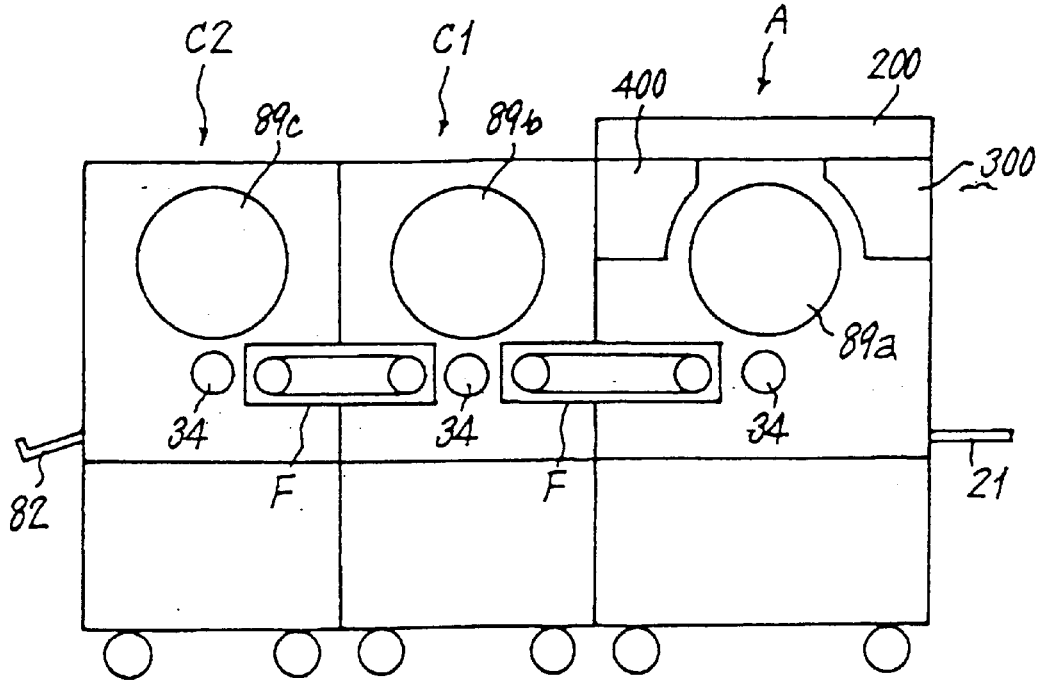
FIG. 17 is a front view showing a multicolor printing system with two auxiliary printers each including a single ink drum connected together.
Figure 18:
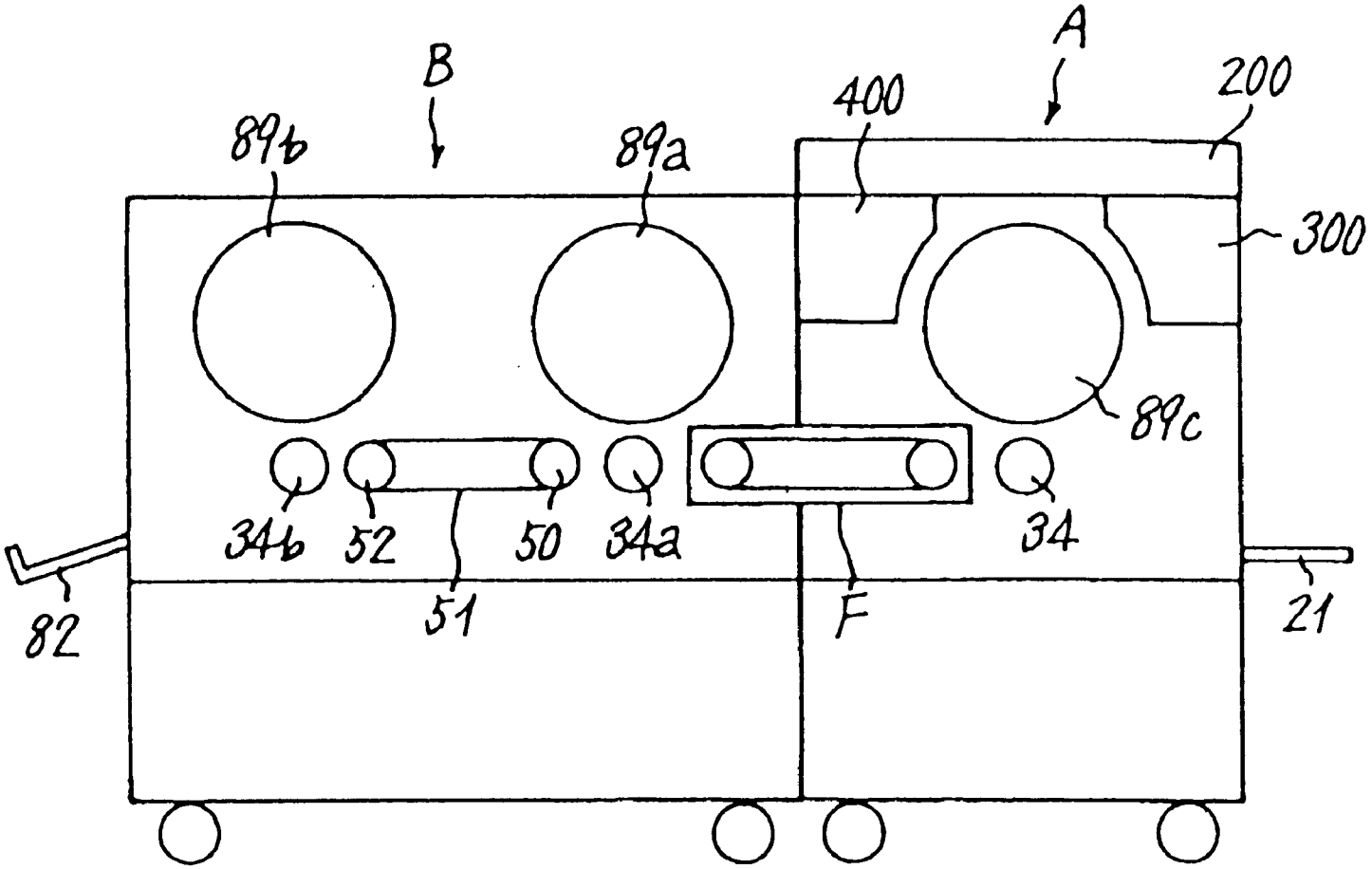
FIG. 18 is a front view showing a multicolor printing system with a single auxiliary printer including two ink drums connected.

In FIG. 17, two stencil printers or auxiliary printers C are serially connected to one side of the stencil printer or main printer A. In FIG. 18, The printer or main printer A and the printer or auxiliary printer B are connected to each other. With any one of such systems, tricolor printing is achievable.

Figure 19:
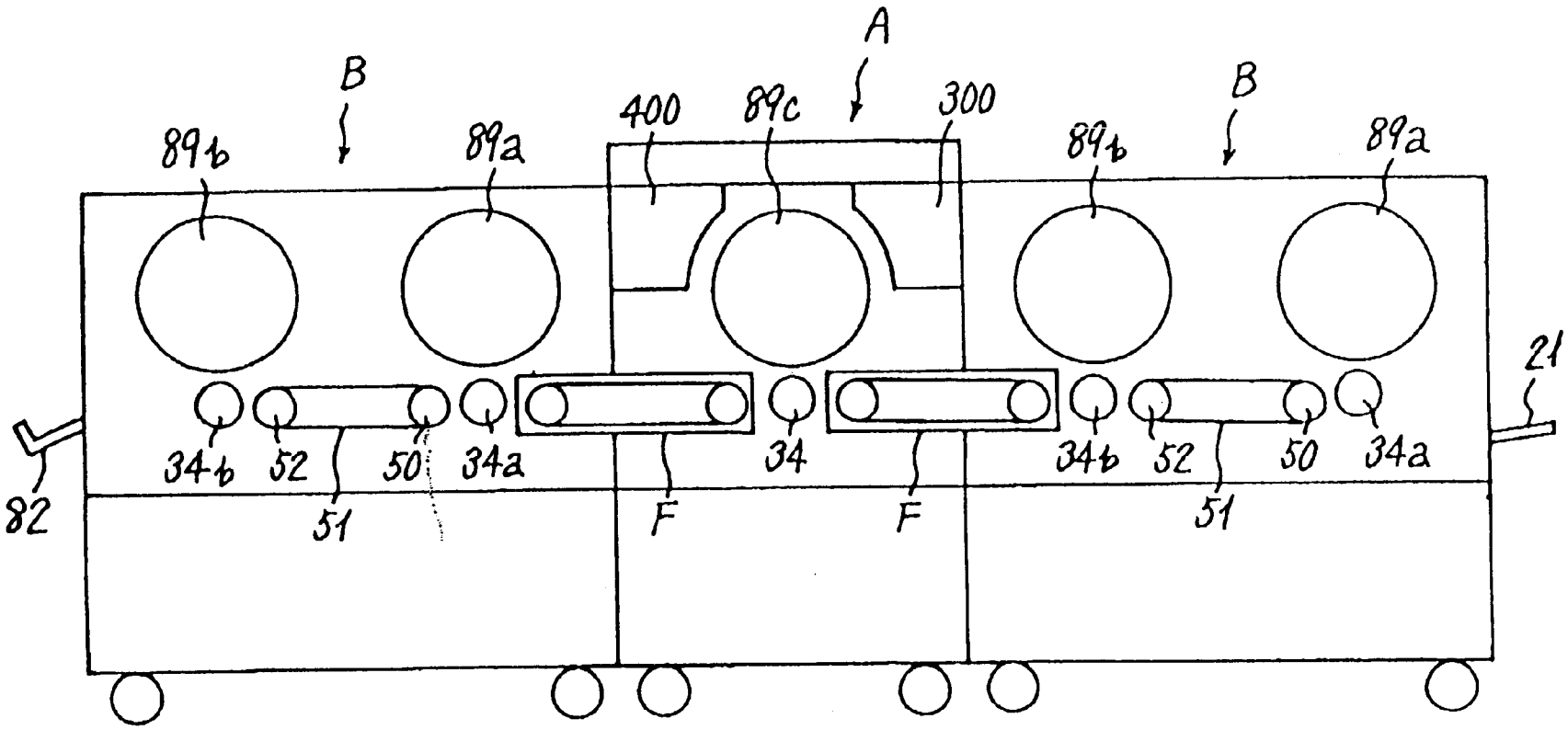
FIG. 19 is a front view showing a multicolor printing system with two auxiliary printers each including two ink drums connected together.

In FIG. 19, two printers or auxiliary printers B are respectively connected to opposite sides of the printer or main printer A. While full-color printing is usually implemented by yellow, magenta, cyan and black, the configuration shown in FIG. 19 allows any desired color to be added to the above four colors in order to effect pentacolor printing.

Figure 20:
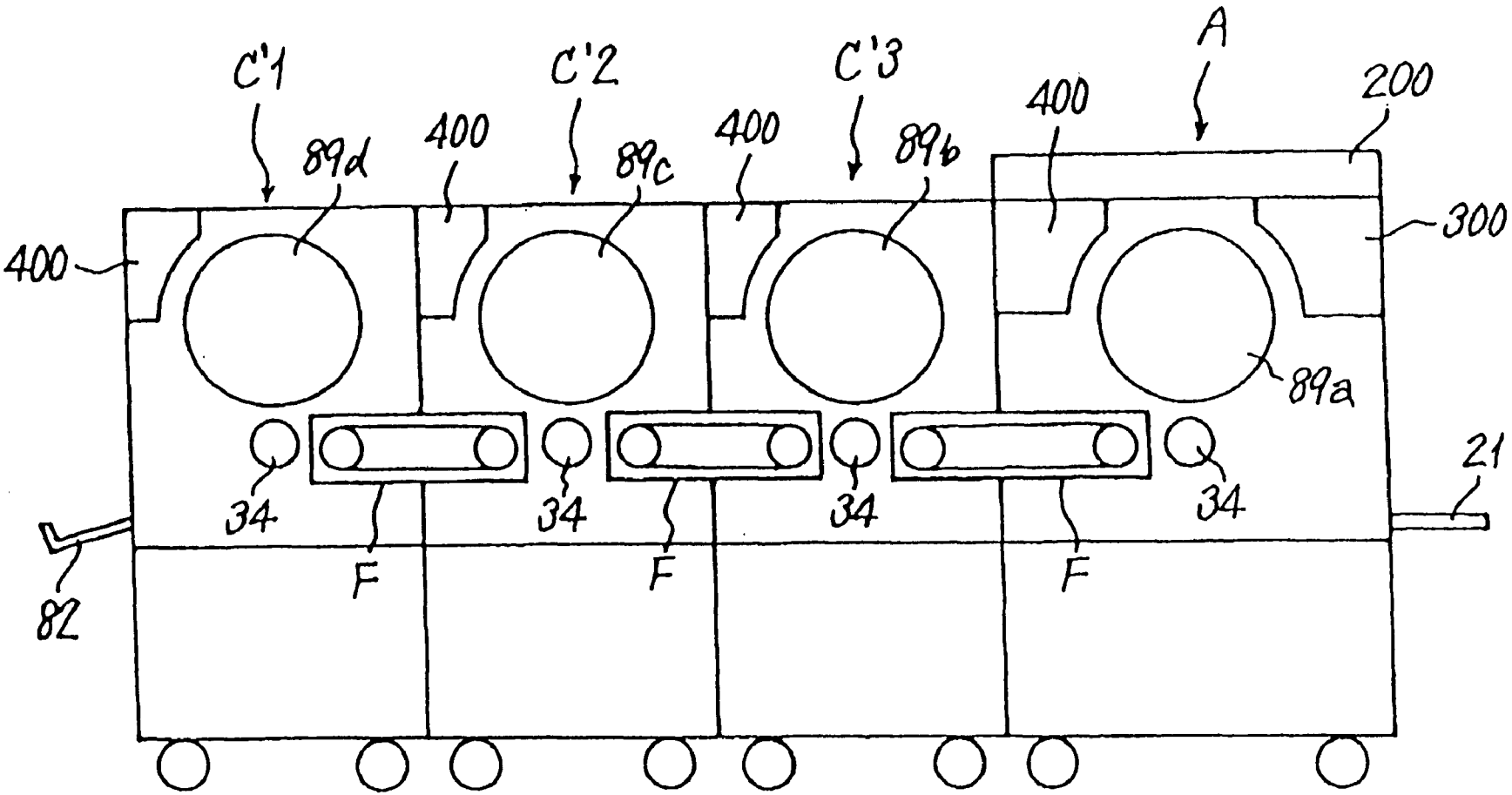
FIG. 20 is a front view showing a multicolor printing system with three auxiliary printers each including a single ink drum connected together.

In FIG. 20, three stencil printers or auxiliary printers C'1, C'2 and C'3 are serially connected to one side of the stencil printer or main printer A. The printers C'1–C'3 each differs from the printer C in that it includes the master discharging device 400. Because the printers C'1–C'3 each has the respective master discharging device 400, used masters can be discharged before the ink drums 89*a*, 89*b*, 89*c* and 89*d* are replaced. Stated another way, the printer A should only feed new masters to each of the ink drums 89*a* –89*d*. This successfully reduces the time up to the start of actual printing. The configuration shown in FIG. 20 is directed toward the reduction of the operator's labor, rather than toward the downsizing feature. It is to be noted that it is not always necessary to arrange the master discharging device 400 in the printer A.

Figure 21:
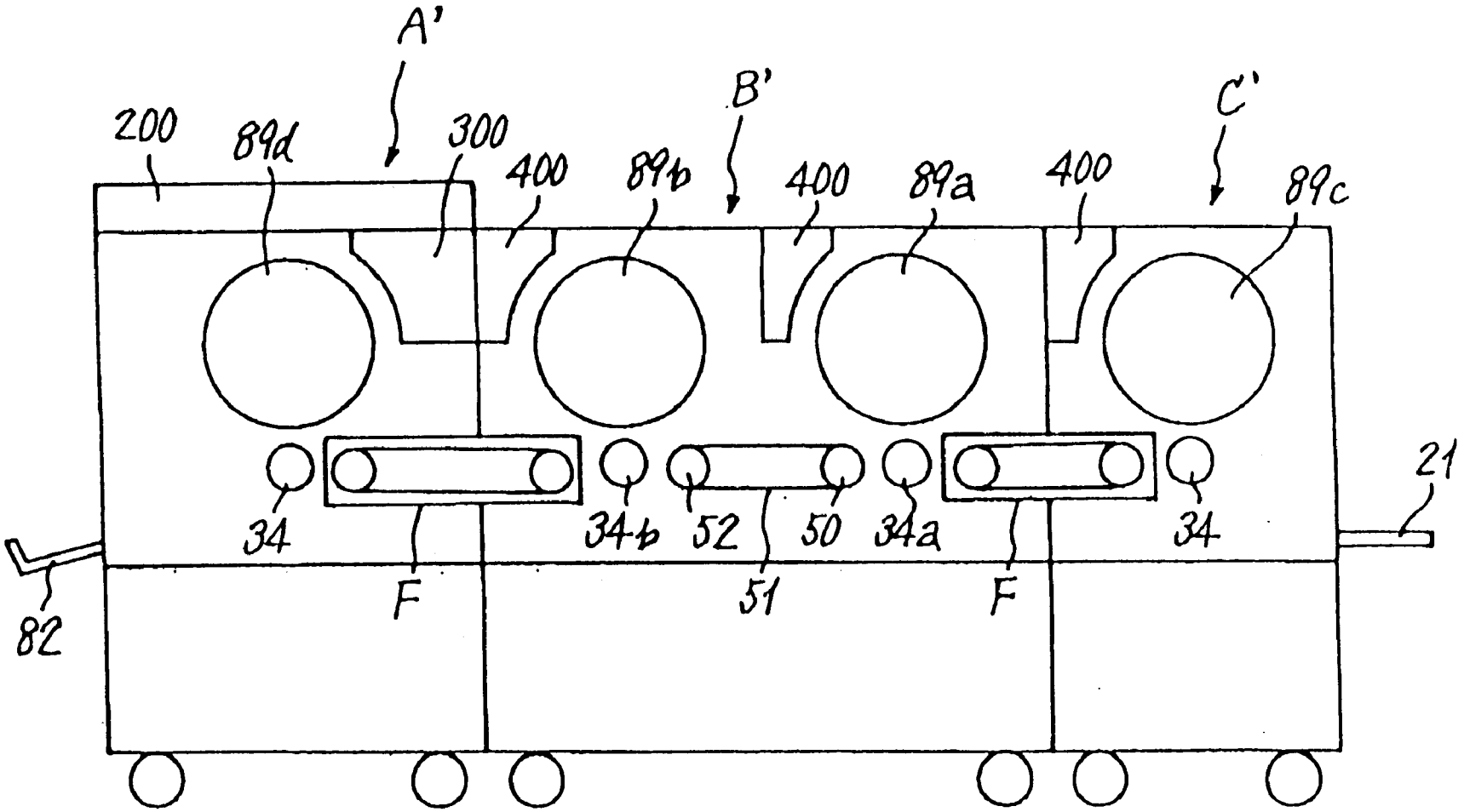
FIG. 21 is a front view showing a multicolor printing system with an auxiliary printer including a single ink drum and an auxiliary printer including two ink drums connected together.

In FIG. 21, two stencil printers or auxiliary printers B' and C' are serially connected to one side of the stencil printer or main printer A. In this embodiment, too, the master discharging device 400 is not always necessary in the printer A. For this reason, the printer A is labeled A' in FIG. 21. The printers A', B' and C' may be operated in a separated condition.

In any case, the printers may be connected in any desired configuration and arranged in an easy-to-operate layout. However, it is desirable that an operation panel be located at the paper discharge side for facilitating the operator's adjustment as to the registration of images of different colors.

Figure 22:
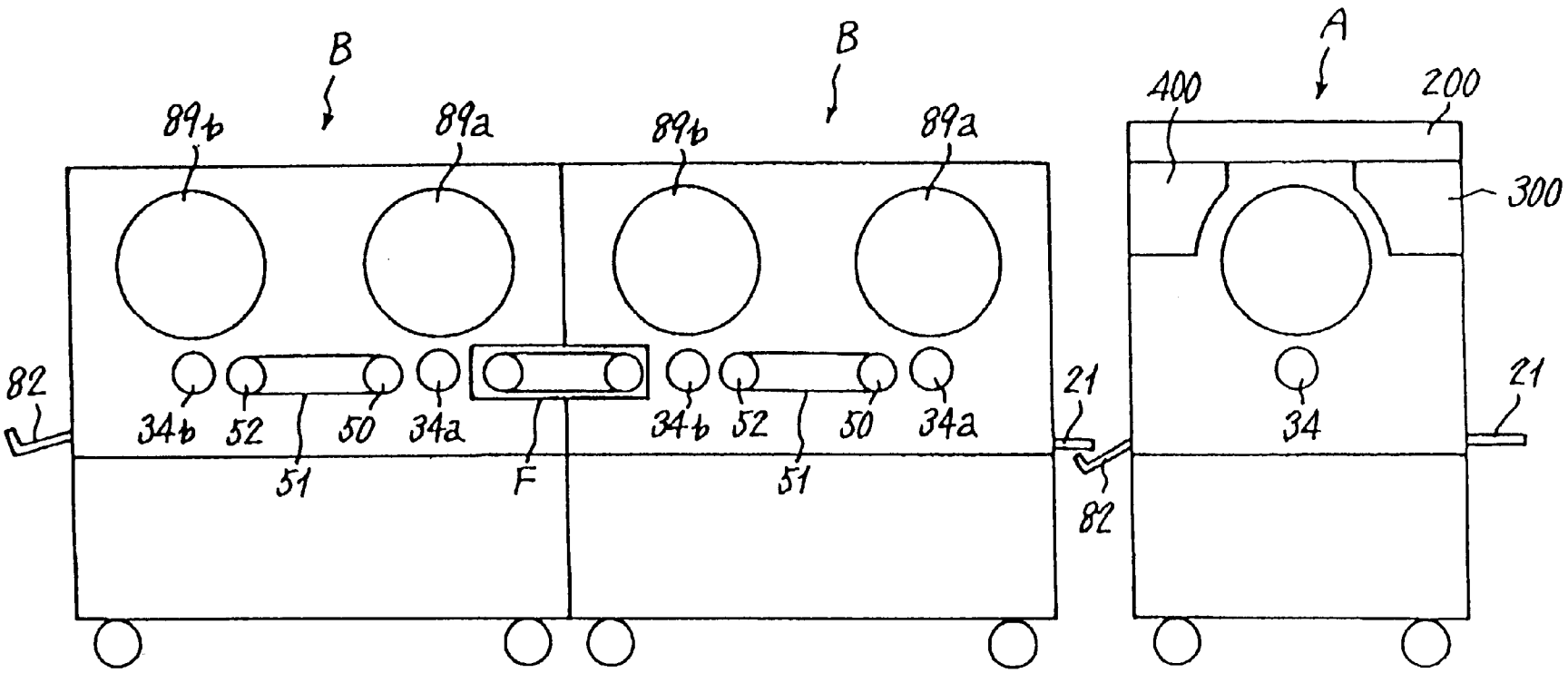
FIG. 22 is a front view showing a multicolor printing system which is the combination of stencil printers each including two drums and a single drum type stencil printer.

FIG. 22 shows two stencil printers B connected together and the stencil printer A independent of, but constituting a system in combination with, the printers B. With this configuration, it is possible to increase the number of colors, compared to the configuration of the first embodiment.

In summary, it will be seen that the present invention provides a printing method and a system therefore having various unprecedented advantages, as enumerated below.

(1) A plurality of ink drums each is fed with a respective master, sharing a single fixed master feeding device. This successfully reduces or fully obviates registration errors at the time of master feed.

(2) A plurality of ink drums each is fed with a respective master, sharing a single master making device. The master making device and a multicolor printer each is so positioned as to play a particular role. This enhances the compact configuration of a multicolor printer and the downsizing of the entire system while obviating registration errors. Further, even when the resolution of the master making device is changed to, e.g., 400 dpi (dots per inch) or 600 dpi, the multicolor printer does not need any change and therefore reduces the user's economic burden when, e.g., the system is graded up. Moreover, various kinds of images are achievable because ink drums with masters made by different kinds of master making devices, e.g., a flash type device and a laser type device can be used in combination. In addition, because the multicolor printer needs only an arrangement for printing, a plurality of drums can be freely arranged, enhancing the freedom of layout.

(3) Because the master making device and multicolor print device are separable from each other, not only the downsizing feature but also free layout are enhanced. The system is therefore space saving when situated in an office.

(4) Because the master making device is implemented by the printer, a positional deviation, for example, can be easily corrected by trial printing before the ink drum is mounted to the multicolor printer. This promotes efficient printing work.

(5) The master making device is implemented by a conventional single drum type printer. This reduces the economic burden on the user while achieving the above advantage (4).

(6) Because the positions for mounting the ink drums are not limited, colors can be reproduced with enhanced freedom.

(7) The printers are interconnected by an intermediate conveyor unit while a fixed master feeding device is used to feed masters to a plurality of ink drums. This enhances accurate registration between masters and allows the number of colors to be easily increased.

(8) The ink drums are mounted or dismounted at an identical angular position throughout the system. The operator can therefore mount or dismount the ink drums with ease. Because the printing devices are so constructed as to receive the ink drums in a preselected positional relation, the positions of the drums can be easily controlled at the start of printing after the mounting or dismounting.

(9) A phase adjusting mechanism acting only on the immediately preceding or upstream ink drum is provided. An image can therefore be readily adjusted in the top-and-bottom direction.

Various modifications will become possible for those skilled in the art after receiving the teachings of the present disclosure without departing from the scope thereof.

What is claimed is:

1. A multicolor printing system comprising:

a plurality of removable ink drums replaceable with each other and capable of implementing simultaneous multicolor printing;

a fixed master feeding device shared by said plurality of ink drums; and at least one master discharging device.

2. A system as claimed in claim 1, wherein said ink drums are replaced in an identical angular position throughout said system.

3. A system as claimed in claim 2, wherein a downstream one of said ink drums in an intended direction of paper conveyance is provided with a phase adjusting mechanism acting only on an upstream one of said ink drums next to the downstream ink drum.

4. A system as claimed in claim 1, wherein a downstream one of said ink drums in an intended direction of paper conveyance is provided with a phase adjusting mechanism acting only on an upstream one of said ink drums next to the downstream ink drum.

5. A multicolor printing apparatus comprising:

a plurality of removable ink drums capable of implementing simultaneous multicolor printing;

master discharging devices identical in number with said plurality of ink drums; and master feeding devices smaller in number than said plurality of ink drums.

6. A multicolor printing apparatus as claimed in claim 5, wherein said ink drums are replaceable with each other.

7. A multicolor printing apparatus as claimed in claim 6, wherein said ink drums are replaced in an identical angular position throughout said printing apparatus.

8. A multicolor printing apparatus as claimed in claim 7, wherein said ink drums are rotated to said identical angular position when said ink drums are removed from said printing apparatus.

9. A multicolor printing apparatus as claimed in claim 8, wherein a downstream one of said ink drums in an intended direction of paper conveyance is provided with a phase adjusting mechanism acting only on an upstream one of said ink drums next to the downstream ink drum.

10. A multicolor printing apparatus as claimed in claim 7, wherein a downstream one of said ink drums in an intended direction of paper conveyance is provided with a phase adjusting mechanism acting only on an upstream one of said ink drums next to the downstream ink drum.

11. A multicolor printing apparatus as claimed in claim 6, where drums are rotated to said identical angular position when said ink drums are removed from said printing apparatus.

12. A multicolor printing apparatus as claimed in claim 11, wherein a downstream one of said ink drums in an intended direction of paper conveyance is provided with a phase adjusting mechanism acting only on an upstream one of said ink drums next to the downstream ink drum.

13. A multicolor printing apparatus as claimed in claim 6, wherein a downstream one of said ink drums in an intended direction of paper conveyance is provided with a phase adjusting mechanism acting only on an upstream one of said ink drums next to the downstream ink drum.

14. A multicolor printing apparatus as claimed in claim 5, wherein said ink drums are replaced in an identical angular position throughout said printing apparatus.

15. A multicolor printing apparatus as claimed in claim 14, wherein said ink drums are rotated to said identical angular position when said ink drums are removed from said printing apparatus.

16. A multicolor printing apparatus as claimed in claim 15, wherein a downstream one of said ink drums in an intended direction of paper conveyance is provided with a phase adjusting mechanism acting only on an upstream one of said ink drums next to the downstream ink drum.

17. A multicolor printing apparatus as claimed in claim 14, wherein a downstream one of said ink drums in an intended direction of paper conveyance is provided with a phase adjusting mechanism acting only on an upstream one of said ink drums next to the downstream ink drum.

18. A multicolor printing apparatus as claimed in claim 14, wherein a downstream one of said ink drum in an intended direction of paper conveyance is provided with a phase adjusting mechanism acting only on an upstream one of said ink drums next to the downstream ink drum.

* * * * *

UNITED STATES PATENT AND TRADEMARK OFFICE

CERTIFICATE OF CORRECTION

PATENT NO. : 6,644,183 B2
DATED : November 11, 2003
INVENTOR(S) : Hironobu Takasawa et al.

It is certified that error appears in the above-identified patent and that said Letters Patent is hereby corrected as shown below:

Column 5,
Line 45, change “includes a damper and a damper shaft” to -- includes a clamper and a clamper shaft --.

Column 6,
Lines 25-26, change “previously mentioned damper rotatable about the damper shaft” to -- previosuly mentioned clamper rotatable about the clamper shaft --.

Column 7,
Line 27, change “with the damper.” to -- with the clamper. --.

Column 9,
Line 25, change “by the damper” to -- by the clamper --.
Line 43, change “damper” to -- clamper --.
Line 46, change “the damper” to -- the clamper --.

Column 10,
Line 10, change “between the damper” to -- between the clamper --.
Line 11, change “the damper” to -- the clamper --.

Column 12,
Line 4, change “the damper” to -- the clamper --.
Lines 13, 14 and 43, change “the dampers” to -- the clampers --.
Lines 26 and 39, change “its damper” to -- its clamper --.
Line 29, change “its damper” to -- the “its clamper --.

Signed and Sealed this

Twenty-ninth Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,644,183 B2
DATED : November 11, 2003
INVENTOR(S) : Takasawa et al.

It is certified that error appears in the above-identified patent and that said Letters Patent is hereby corrected as shown below:

Column 20,
Lines 18 - 19, change “as claimed in claim 14,” to -- as claimed in claim 5, --.

Signed and Sealed this

Twenty-eighth Day of December, 2004

JON W. DUDAS
*Director of the United States Patent and Trademark Office*